US007416248B2

(12) United States Patent
Rojas

(10) Patent No.: US 7,416,248 B2
(45) Date of Patent: Aug. 26, 2008

(54) ADJUSTABLE CONFIGURATION SEATING

(76) Inventor: Robert R. Rojas, 2840 N. Ocean Blvd., Apt. 1102, Fort Lauderdale, FL (US) 33308

( * ) Notice: Subject to any disclaimer, the term of this patent is extended or adjusted under 35 U.S.C. 154(b) by 0 days.

(21) Appl. No.: 11/822,295

(22) Filed: Jul. 3, 2007

(65) Prior Publication Data

US 2007/0252415 A1 Nov. 1, 2007

Related U.S. Application Data

(63) Continuation-in-part of application No. 11/087,641, filed on Mar. 24, 2005, now abandoned.

(51) Int. Cl.
*A47C 13/00* (2006.01)
*A47C 7/00* (2006.01)

(52) U.S. Cl. ..... 297/3; 297/1; 297/283.2

(58) Field of Classification Search ..... 297/1, 297/3, 92–94, 244, 283.2, 283.3, 452.65
See application file for complete search history.

(56) References Cited

U.S. PATENT DOCUMENTS

| | | | | | |
|---|---|---|---|---|---|
| 17,794 | A | * | 7/1857 | La Mothe | 297/94 |
| 67,556 | A | | 8/1867 | Jouett | |
| 191,733 | A | * | 6/1877 | True | 297/1 |
| 395,870 | A | * | 1/1889 | Blydenburgh | 297/235 |
| 466,773 | A | * | 1/1892 | Clarkson | 297/235 |
| 633,012 | A | | 9/1899 | Kidd et al. | |
| 1,381,136 | A | | 6/1921 | Ribiero | |
| 1,912,282 | A | | 5/1933 | Krebs | |
| 1,945,580 | A | | 2/1934 | Turnai | |
| 2,243,502 | A | | 5/1941 | Freedman | |
| 2,429,939 | A | * | 10/1947 | Masterson et al. | 482/142 |
| 2,440,979 | A | * | 5/1948 | Schneider | 297/3 |
| 2,611,418 | A | | 9/1952 | Antelman | |
| 3,099,477 | A | * | 7/1963 | O'Herron | 297/1 |
| 3,121,587 | A | | 2/1964 | Bavaro | |
| 3,482,870 | A | * | 12/1969 | Janssen | 297/92 |
| 3,972,559 | A | | 8/1976 | Anacker | |
| 4,248,476 | A | * | 2/1981 | Phelps | 297/118 |
| 4,605,261 | A | | 8/1986 | Lee | |
| 4,715,650 | A | | 12/1987 | Berman et al. | |

(Continued)

FOREIGN PATENT DOCUMENTS

| | | |
|---|---|---|
| CH | 662258 | 9/1987 |

(Continued)

*Primary Examiner*—David R Dunn
*Assistant Examiner*—Tania Abraham
(74) *Attorney, Agent, or Firm*—Richard C. Litman

(57) ABSTRACT

The adjustable configuration seating has a pair of opposed lateral rigid frame members with seat and back panels extending therebetween. In some embodiments, the chair includes flexible panels secured in place between the two frame members by crossmembers extending between the frame members, with a single adjustably positionable tension crossmember also extending between the frame members to hold the seat and back panel taut. Conversion between relatively upright and reclining configurations is accomplished by repositioning the tension crossmember between the frames, and turning the assembly ninety degrees to position the selected seating surface to face generally upwardly. Other embodiments have rigid seating and back panels, with the backrest panel articulating between the frame members to allow the seating configuration to change. The backrest panel may be secured to the seating panels by a rigid or flexible intermediate panel.

6 Claims, 16 Drawing Sheets

U.S. PATENT DOCUMENTS

| | | | | |
|---|---|---|---|---|
| 4,836,601 | A | | 6/1989 | Cone |
| 5,058,950 | A | | 10/1991 | Mann |
| 5,244,250 | A | | 9/1993 | Nordmeyer |
| 5,415,454 | A | * | 5/1995 | Fu-Tsung ..... 297/3 |
| 5,709,428 | A | | 1/1998 | Hugghins |
| D395,763 | S | | 7/1998 | Machell |
| 5,797,655 | A | | 8/1998 | Miles |
| 5,882,068 | A | | 3/1999 | Levine |
| 6,158,069 | A | | 12/2000 | Boothe |
| 6,264,271 | B1 | | 7/2001 | Munn et al. |
| D456,628 | S | | 5/2002 | Satoshi |
| 6,547,322 | B2 | | 4/2003 | Marx |
| 6,607,240 | B2 | | 8/2003 | Zheng |
| 6,669,280 | B1 | | 12/2003 | Wegner |
| 6,698,827 | B2 | | 3/2004 | Le Gette et al. |
| 6,752,452 | B2 | | 6/2004 | Choi et al. |
| 6,783,183 | B2 | | 8/2004 | Tseng |
| 2002/0043822 | A1 | | 4/2002 | Choi et al. |
| 2003/0034675 | A1 | | 2/2003 | Marx |
| 2003/0071493 | A1 | | 4/2003 | Miyagi |
| 2004/0135405 | A1 | | 7/2004 | Zheng |

FOREIGN PATENT DOCUMENTS

| | | |
|---|---|---|
| GB | 2240034 | 7/1991 |
| JP | 6-098816 | 4/1994 |
| JP | 6-197821 | 7/1994 |

* cited by examiner

ADJUSTABLE CONFIGURATION SEATING

REFERENCE TO RELATED PATENT APPLICATION

This application is a continuation in part of U.S. patent application Ser. No. 11/087,641 filed on Mar. 24, 2005 now abandoned.

BACKGROUND OF THE INVENTION

1. Field of the Invention

The present invention relates generally to adjustable chairs and seating. More particularly, the adjustable configuration seating is a dual configuration chair having seating and back panels which may be quickly and easily converted from a generally upright seating position using one side of the seating and back panels, to a more reclined seating position using the opposite side of the seating and back panels.

2. Description of the Related Art

The desirability and need for chairs and seating surfaces having multiple configurations has been recognized for some time. Seating which is convertible between a relatively upright position and a reclining position is desirable due to its versatility and the ability to combine two (or more) different types of seating configurations into a single unit, thereby saving space and expense.

Most such adjustable configuration chairs or seats are relatively large, heavy, and immobile units, offering excellent comfort but also being relatively heavy and bulky. Lighter weight and more compact chairs have also been manufactured which provide portability for camping, beach use, etc. Most such portable seating is foldable for compact storage and transport, and many of these portable chairs are also convertible between relatively upright and reclining positions, as desired. However, all such convertible and portable chairs of which the present inventor is aware require some articulation of the lateral frame members, which results in a weaker frame than is achievable in a rigid, fixed structure. Moreover, none of the chairs and seats known to the present inventor makes use of both sides of a seating and/or backrest panel.

An example of such a chair is described in the drawings and English abstract of Swiss Patent No. 662,258, published on Sep. 30, 1987, which describes a folding chair that is convertible between relatively upright reclining positions by means of the articulation of the lateral frame assemblies.

Another folding chair is shown in Japanese Patent No. 6-98,816, published on Apr. 12, 1994. This chair is formed of relatively thick support and seating components, with a generally U-shaped back portion having a relatively shallow depth. The seat folds into the back portion between the shallow arms, with the forward portions of the sides and arms folding inwardly across the front of the assembly.

Another portable, folding seat is found in Japanese Patent No. 6-197,821, published on Jul. 19, 1994. This device has a configuration somewhat like that of a so-called "director's chair," in which the legs are diagonally braced. The upper ends of the diagonals have collars that slide along the four uprights, allowing the uprights to be drawn together for folding the chair. This chair appears to have only a single seating configuration when deployed for use.

None of the above inventions and patents, taken either singly or in combination, is seen to describe the instant invention as claimed. Thus, adjustable configuration seating solving the aforementioned problems is desired.

SUMMARY OF THE INVENTION

The adjustable configuration seating is convertible between relatively upright and reclining configurations. Two opposed lateral frames are used to support the seating and back panels therebetween. The lateral frames are rigid, rectangular units, and do not fold, articulate, or disassemble in any way.

In some embodiments, a flexible seating web or sling is tautly secured between the two frames by a series of seating panel support crossmembers and a single tension crossmember. Conversion between the two seating configurations is accomplished by moving the lateral tension crossmember from a first to a second location across the two frames, thereby altering the path of the seating web or sling between the two frames. The entire assembly is then rotated ninety degrees to position the selected seating surface to face generally upwardly, with the seating surface for the other configuration positioned generally below the selected seating surface.

The adjustable configuration seating with its flexible seating surfaces may be folded for storage or transport by removing all of the lateral seating surface support crossmembers and the single tension rod, thereby allowing the seating web or sling to be removed and the two frames to be placed together. The two lateral frames may include means for folding, if so desired, for even more compact storage and shipping. Alternatively, the seating surface support crossmembers may be provided with hinges or the like and means for locking the hinges rigidly when the chair is deployed. Folding is accomplished by unlocking the support crossmembers and removing the tension crossmember, thereby allowing the two frames to be drawn together and folding the seating surface therebetween. Additional versatility may be provided by elongating the crossmembers and widening the panel surfaces to provide seating for more than one person, and/or providing additional intermediate frame members for additional support between each seating panel, as desired.

In other embodiments, the seating comprises a chair having rigid side frames. However, the seating and backrest panels are rigid, with the backrest panel including a slot therein to enable the panel to articulate and reposition a short intermediate panel between the lower edge of the backrest panel and the rear edges of the two seat bottom panels. The seat bottom panels are rigidly and immovably affixed between the two lateral frame members, with no folding capability being provided. Another embodiment based upon the rigid panel structure includes a relatively short or narrow intermediate panel of flexible material. This obviates the need for longitudinal articulation of the backrest panel, with the backrest panel pivoting between either of the two configurations, and the flexible intermediate panel folding between the lower edge of the backrest panel and the rear edges of the two rigid seating panels when the chair is repositioned to either configuration.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a seating device having an adjustable or variable configuration, and also optionally providing for lateral folding or collapsing with the two lateral frame members remaining in their rigid, unfolded state. In some embodiments, the seat or chair utilizes a web or sling member for the seating and back surfaces, with opposite sides or surfaces of the web or sling being used for the different seating configurations.

Figure 1:
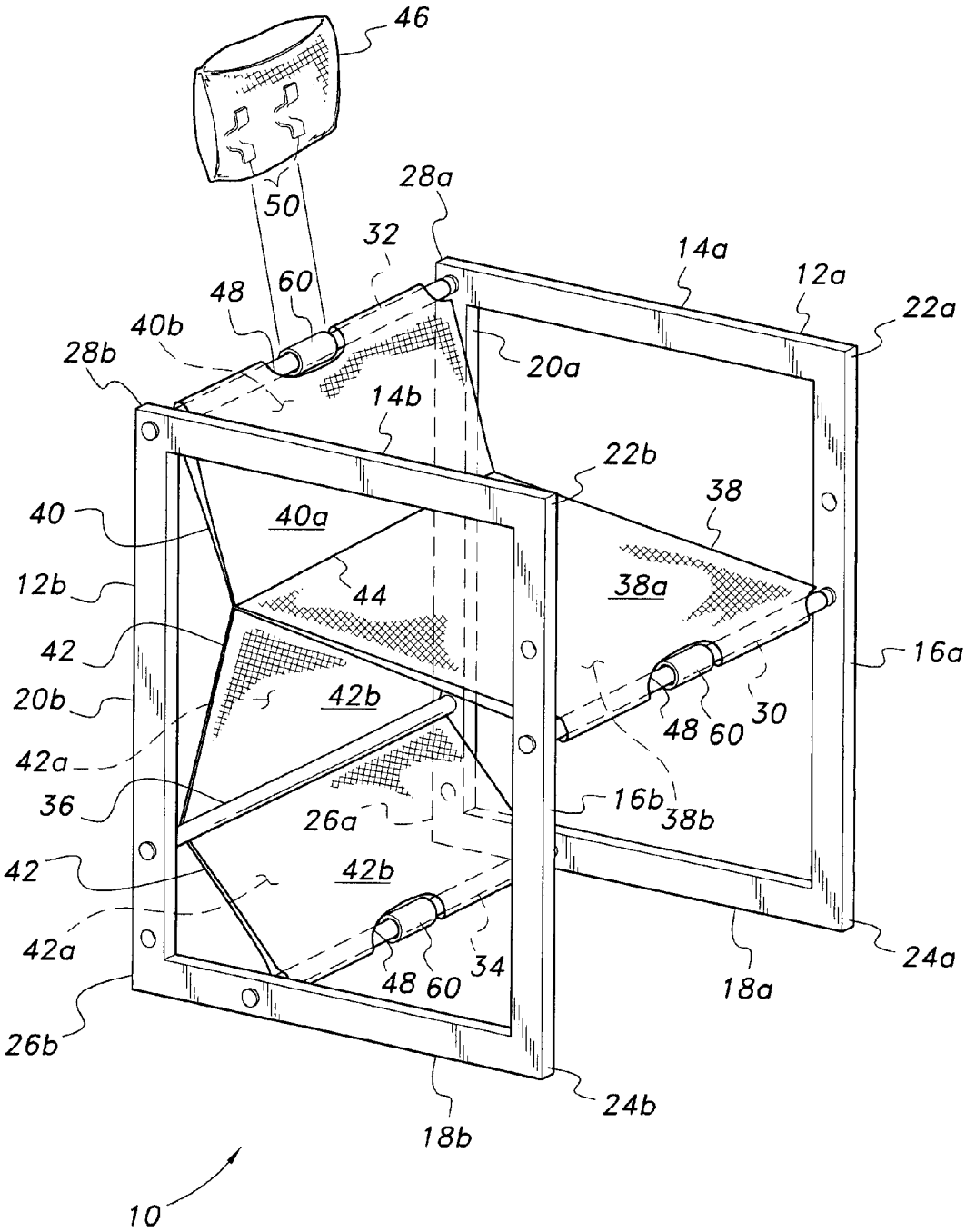
FIG. 1 is a perspective view of a first embodiment of the adjustable configuration seating according to the present invention, with the chair shown in an upright position and an optional headrest shown exploded therefrom.

FIG. 1 of the drawings illustrates the adjustable configuration seating in its generally upright seating configuration. The seat or chair 10 includes laterally opposed first and second rigid lateral frame members, respectively 12*a* and 12*b*, with a series of crossmembers supporting a web or sling type panel therebetween. The two lateral frame members 12*a* and 12*b* are each rigid, non-foldable units that retain their shapes at all times; no folding or articulation is provided for either of the lateral frame members 12*a* and 12*b*, *per se*. While the two frame members 12*a* and 12*b* are shown as having open rectangular configurations, it will be seen that these two frame members may comprise continuous panels having closed interior areas, if so desired. The interiors of the frame members 12*a* and 12*b* may be closed by solid, rigid structure, or covered using fabric or other non-structural material, as desired.

Each frame member 12*a*, 12*b* includes four sides, respectively 14*a* through 20*a* for the first frame member 12*a*, and 14*b* through 20*b* for the second frame member 12*b*. It will be noted that the sides 14*a*, 14*b* and 18*a*, 18*b* are somewhat shorter than the sides 16*a*, 16*b* and 20*a*, 20*b*. The sides of each frame member form four corners, respectively 22*a* through 28*a* for the first frame member 12*a* and 22*b* through 28*b* for the second frame member 12*b*. It is not absolutely essential that the corners 22*a* through 28*b* of the frame members be comprise acute corners as shown in the drawings; the corners may be rounded, beveled, chamfered, etc., as desired. The two frame members 12*a*, 12*b* may be formed of any suitable rigid and sturdy material, e.g., wood, metal, dense plastic, etc., or some composite combination thereof in either solid or hollow tubular form, as desired.

A series of seat and back panel retaining crossmembers extend between the two frame members 12*a* and 12*b*, and support a seat and back panel thereon. Each of the crossmembers may comprise a rigid, inflexible rod, bar, or tube, or may alternatively provide for folding, as desired. A first panel retaining or support crossmember 30 extends between the two second sides 16*a*, 16*b* of the two frames and generally medially between the two corners 22*a*, 24*a* and 22*b*, 24*b*, with a second panel retaining crossmember 32 extending between the two corners 28*a*, 28*b* of the frame members, and a third crossmember 34 extending between the two frame sides 18*a*, 18*b*, crossmember 34 being closer to corners 26*a*, 26*b* than corners 24*a*, 24*b*. A fourth, selectively positionable seat and back panel tensioning member 36 also extends between the two lateral frame members, with the tensioning member 36 installed between the fourth sides 20*a*, 20*b* of the frame members in the upright seating configuration of FIG. 1, tensioning member 36 being closer to frame corners 26*a*, 26*b* than corners 28*a*, 28*b*.

A continuous, thin, flexible seat and back panel is secured to the various panel retaining crossmembers 30 through 34 and wraps partially around the tensioning member 36. The seat and back panel comprises three general portions. A first, large portion 38 extends from the first panel retaining crossmember 30, with a second, relatively short portion 40 extending from the second panel retaining crossmember 32 and a third large portion 42 extending from the third crossmember 34 and wrapping partially about the tension crossmember 36. The various panel portions 38, 40, and 42 are all joined together (e.g., stitched or bonded for fabrics, etc.) along a common lateral seam 44.

Figure 4:
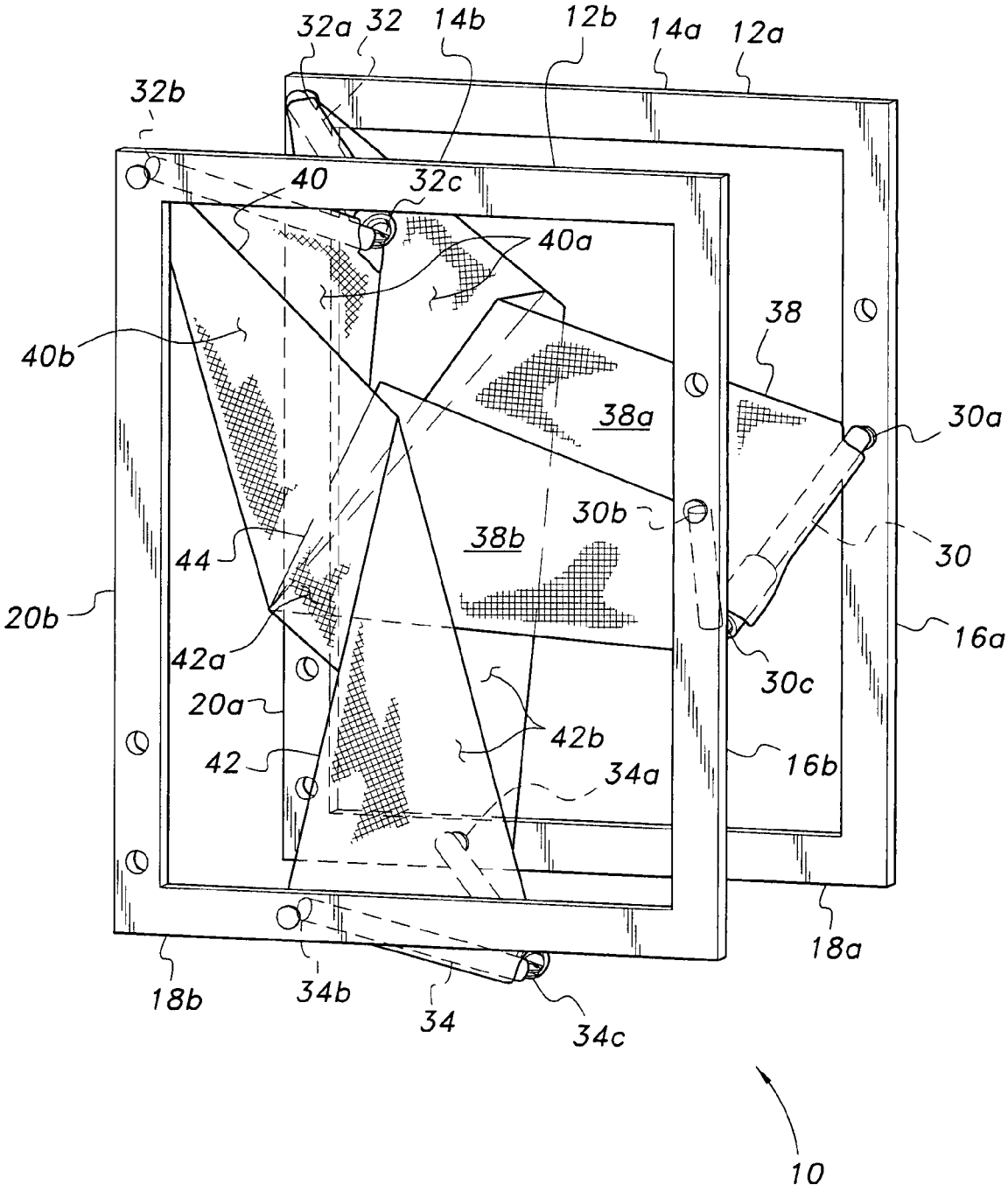
FIG. 4 is a perspective view of an embodiment of the adjustable configuration seating of the present invention in a partially folded state, with the crossmembers partially folded.
Figure 5:
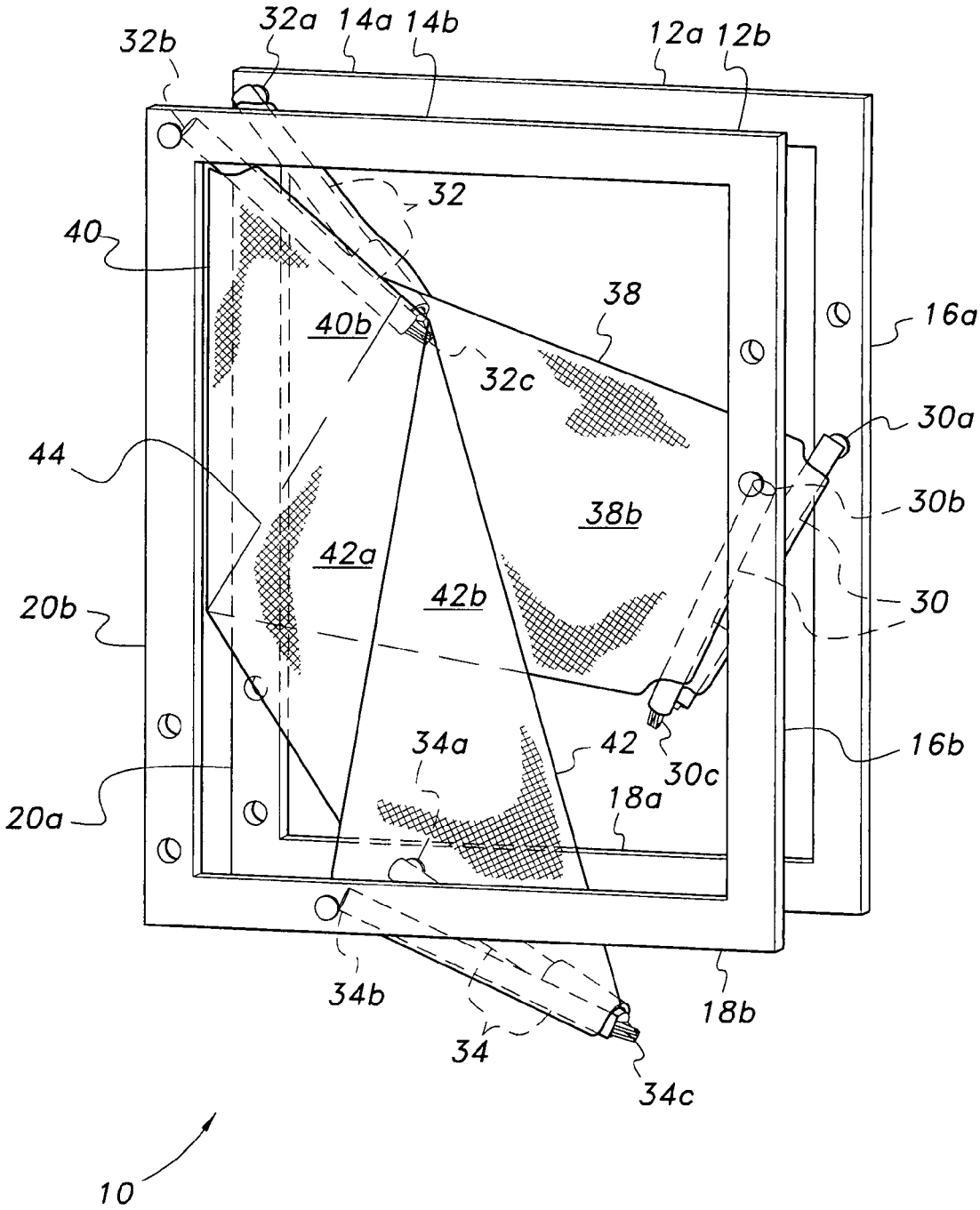
FIG. 5 is a perspective view of the adjustable configuration seating of FIG. 4 in a completely folded state.

Any suitable thin, flexible, substantially inelastic (slight stretching may be acceptable) sheet material may be used to form the panel and its three portions 38 through 42 as desired, e.g., woven fabric; plastic; leather or metal screen or mesh; continuous, impervious sheet materials (plastic, leather, etc.); large gauge mesh materials (e.g., knitted or knotted cord or rope as in a hammock), etc., as desired. It will be noted that in the example illustrated in FIGS. 1 through 3 and in FIG. 6, that the three panel portions 38 through 42 actually each comprise two substantially parallel sheet surfaces or plies, i.e., plies 38*a*, 38*b* for the portion 38, plies 40*a*, 40*b* for the portion 40, and plies 42*a*, 42*b* for the panel portion 42. Each portion 38 through 42 extends from the common seam 44 to wrap about the respective crossmember 30 through 34 and extend back to the seam 44. In this manner, a finished surface always faces outwardly and is exposed as the seat and back surface for the seat or chair 10, regardless of its orientation and configuration. Alternatively, each portion of the back and seating surfaces may comprise a single sheet or ply of material secured about its respective crossmember 30 through 34 by means of a tubular hem, if so desired. Such a single ply embodiment is shown in FIGS. 4 and 5, illustrating the lateral folding action of the foldable or collapsible embodiment of the present seating, discussed further below.

Figure 2:
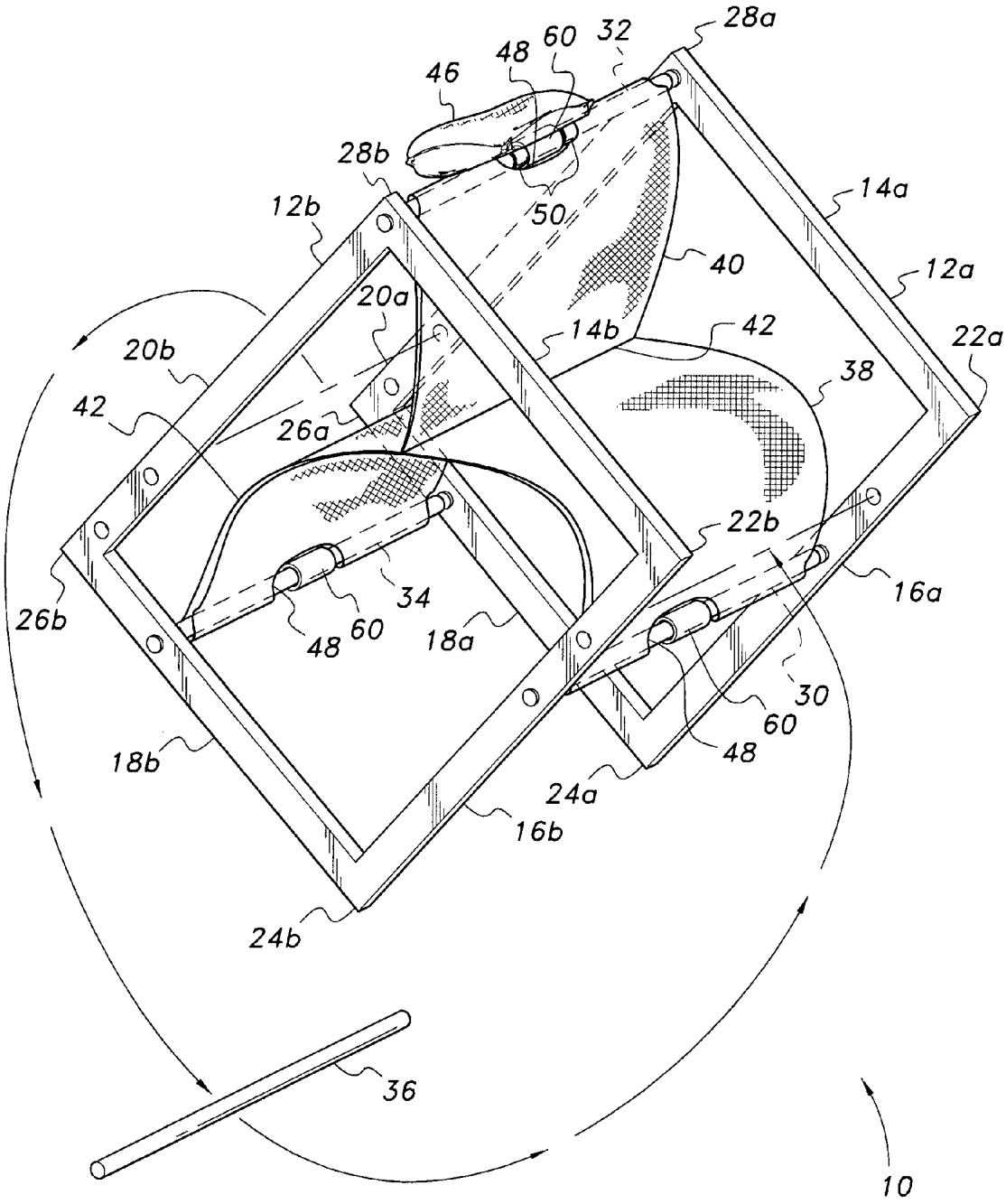
FIG. 2 is a perspective view of the adjustable configuration seating of FIG. 1 in an intermediate or transition configuration, the tensioning member being exploded to show conversion from the upright configuration of FIG. 1 to the reclining configuration of FIG. 3.
Figure 3:
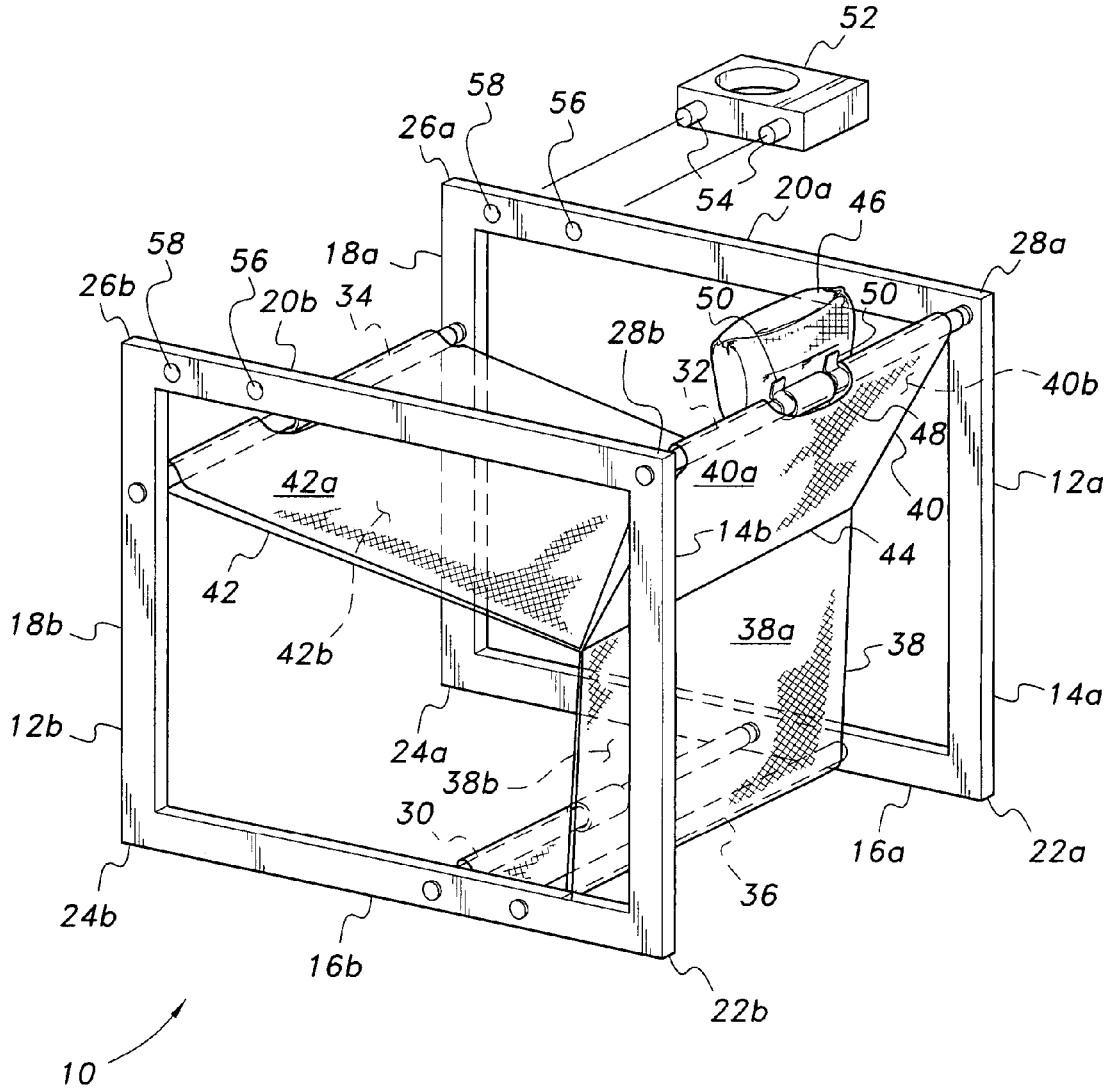
FIG. 3 is a perspective view of the reclining configuration of the adjustable configuration seating of FIGS. 1 and 2 reconfigured to a second seating configuration, also showing an optional removably attachable armrest accessory exploded therefrom.

FIG. 3 provides an illustration of the second, reclining configuration for the seating of FIG. 1, with FIG. 2 illustrating an intermediate configuration as the seating is reconfigured from its generally upright configuration shown in FIG. 1 to its reclining configuration shown in FIG. 3. In FIG. 2, the tensioning member 36 for the seating panels 38 through 40 has been removed from its position in the upright chair configuration, thereby removing tension in the panel portion 42, which serves as the tensioning panel in the upright configuration. The other two panels 38 and 40 also slacken, due to their common seam 44 with the slackened panel 42. All three of the seat and back panel retaining crossmembers 30 through 34 remain in position across the two lateral frame members 12*a* and 12*b*, and continue to secure the seat and back panels 38 through 42 therebetween. The seating 10 has also been turned or rotated clockwise by about 45° in FIG. 2 from its upright orientation in FIG. 1.

In FIG. 3, the seating 10 is rotated 90° clockwise from its upright orientation in FIG. 1, with the tension crossmember 36 reinstalled across the two frame sides 16*a*, 16*b*, generally opposite its installation across the sides 20*a*, 20*b* for the upright configuration of FIG. 1. In the reclining configuration of FIG. 3, the tension member extends across the first panel portion 38 of the seating and back panel, i.e., the panel portion used as the seating portion in the upright seating configuration. This panel 38 is positioned in the lower portion of the chair 10, beneath the other panel portions 40 and 42 in FIG. 3, due to the clockwise rotation of the assembly by 90° between FIG. 1 and FIG. 3. Accordingly, the third panel portion 42, which was the tension panel in FIG. 1, becomes the seating portion for the reclining configuration shown in FIG. 3.

Specifically, the first ply 42*a*, which was facing outwardly away from the tension member in the upright configuration of FIG. 1, becomes the upwardly facing seating portion in the reclining configuration of FIG. 3. The back panel 40 serves the same function in both chair configurations, but the first ply 40*a* serves as the back contact panel in the upright configuration of FIG. 1, while the second ply 40*b* serves as the back contact panel in the reclining configuration of FIG. 3. The panels 38 through 42 of the seating 10 provide a much more reclined orientation in the configuration of FIG. 3 as opposed to the upright configuration of FIG. 1, due to the reorientation of the rectangular lateral frame members 12*a* and 12*b* to rest upon two of their longer sides in FIG. 3 and the adjustment of the geometry of the three panel portions 38 through 42 due to the repositioning of the tension member 36.

It will be noted that the chair or seating 10 of FIGS. 1 through 3 may also include a backrest or headrest cushion 46 removably secured thereto. The cushion 46 may extend somewhat higher than shown in FIGS. 1 through 3, and may provide further head and/or back support in addition to the relatively low backrest panel 40 of the chair 10. The crossmember attachment edge of the backrest panel 40 includes a cutout 48 therein, as do the other panel portions 38 and 42. The cushion 46 includes a pair of crossmember attachments 50, e.g., openable fabric loops removably secured by snaps, mating hook and loop fabric material, etc., which secure removably about the second panel retaining crossmember 32 within the panel 40 edge cutout 48.

As this crossmember 32 serves as the uppermost structural member of the seating 10 to support the upper edge of the backrest panel 40 in both seating configurations, the cushion 46 need only be flipped over from one side of the backrest panel 40 to the other as the chair configuration is changed, to provide a head or upper back cushion in either configuration. Alternatively, the cushion 46 may be flipped to the unused surface of the backrest panel, if the user of the seating 10 does not wish to use the cushion or the cushion may be removed completely by opening the attachment straps 50 securing it to the crossmember 32, if so desired. While the cushion 46 may serve primarily as a head or upper back cushion, it will be seen that it may be secured about either of the other two crossmembers 30 or 34 for use thereon, if so desired.

FIG. 3 also illustrates another accessory that may be provided with the present adjustable configuration seating. In FIG. 3, an armrest accessory 52 (e.g., cupholder, ashtray or other tray, etc.) is shown separated from the upper edge or arm 20*a* of the first or right frame member 12*a*. A pair of pins 54 extends from the accessory 52, with one of the pins inserting removably into the existing hole or passage 56 for the tension member 36 when the seating is in its upright configuration and the other pin fitting into a specially provided accessory attachment hole 58. It will be seen that an additional left side attachment hole is also provided in the second frame member 12*b*, and that additional accessory attachment holes (not shown) may be provided for installation of the accessory 52 at a convenient location when the seating 10 is oriented in its upright configuration, if so desired.

While the two lateral frame members 12*a* and 12*b* do not fold, collapse, or articulate in any manner, the adjustable configuration seating may be constructed to provide laterally inwardly folding or collapsing of the crossmember structure for compact storage, if so desired. FIGS. 4 and 5 illustrate the folding of a folding embodiment of the seating. It has been noted further above that all of the three panel retaining members 30 through 34 may comprise rigid, unitary lengths of material, if so desired, and may be made to be removable from the two side frames 12*a* and 12*b* to permit the chair or seating to be collapsed for storage.

However, the panel retaining members 30 through 34 may be constructed with end hinges 30*a*, 30*b*, 32*a*, 32*b*, and 34*a*, 34*b* for the respective frame 12*a*, 12*b* attachment ends of the three crossmembers 30 through 34. Central hinges 30*c*, 32*c*, and 34*c* are also provided respectively along each of the crossmembers 30 through 34, to permit them to fold or collapse inwardly, thereby allowing the frames 12*a* and 12*b* to draw together for compact storage of the seating unit 10. Examples of hinges and pivots which may be used with the present seating are shown and described in U.S. Pat. No. 4,715,650 issued on Dec. 29, 1987 to Cary Berman et al., titled "Fully Collapsible Portable Chair," which is hereby incorporated by reference in its entirety. Locking sleeves 60 (shown most clearly in FIGS. 1 and 2) slide over the central hinge assemblies 30*c* through 34*c* to hold each of the respective pivotally connected panel retaining member components as straight, rigid assemblies when the chair is being used. The single tension member 36 is removed from between the two lateral frame members 12*a* and 12*b* before folding the seating 10, as the tension member 36 is removed and repositioned in any event according to the seating configuration desired.

The seating assembly in FIGS. 4 and 5 is shown in its upright orientation, i.e., with the longer sides or legs 16*a*, 16*b* and 20*a*, 20*b* of the two lateral frames 12*a*, 12*b* oriented generally vertically. In FIG. 4, the three locking sleeves 60 have been moved axially from their positions over their respective hinges 30*c*, 32*c*, and 34*c* of the three panel retaining members 30 through 34, allowing the crossmembers 30 through 34 to hinge or fold at their central hinge points and at their end hinge attachment points to the two lateral frame members 12*a* and 12*b* as well. The seating assembly 10 is shown partially folded in FIG. 4, with complete folding shown in FIG. 5.

The various panel portions are illustrated as single thicknesses in the embodiment of FIGS. 4 and 5 for clarity in the drawings, and as an alternative embodiment as well. The same nomenclature used to describe the panel portions in FIGS. 1 through 3 is used in FIGS. 4 and 5, with it being understood that the panel references refer to opposite surfaces of a single ply in FIGS. 4 and 5, rather than to two generally parallel plies, as in the embodiment of FIGS. 1 through 3.

In FIG. 4, the first crossmember 30 is folding downwardly, i.e., with its central hinge 30*c* moving toward the plane between the two lower sides 18*a*, 18*b* of the two frames 12*a*, 12*b*. This results in the first panel 38 folding downwardly as well, with its first surface 38*a* folding inwardly and its opposite second surface 38*b* (the lower surface when the seating is deployed as shown in FIG. 1) facing outwardly to each side of the central fold.

Simultaneously with the above, the second crossmember 32, which supports the upper edge of the back panel 40, is hinging forwardly, with its central hinge 32*c* moving toward the plane between the two forward edges 16*a* and 16*b* of the two frame members 12*a*, 12*b*. This results in the upper edge of the back panel 40 forming an inwardly V-shaped fold, while its lower edge, i.e., the edge along the panel assembly seam 44, folds downwardly, as indicated in FIGS. 4 and 5.

At the same time, the third crossmember 34 is folding, with its central hinge 34*c* moving forwardly and passing slightly beyond the plane defined by the two lower sides 18*a* and 18*b* of the two lateral frames 12*a* and 12*b*. This results in the lower, outer portions of the first face 42*b* of the third panel 42 folding to face outwardly, with the remainder of the first face 42*b* of the third panel 42 folding inwardly to capture the rearward portion of the first panel 38 therebetween. The result is a compactly folded structure with the two lateral frames 12*a* and 12*b* disposed closely adjacent and parallel to one another, separated only by the thicknesses of the folded crossmembers 30 through 34 and the thickness of the folded panel portions 38 through 42, as shown in FIG. 5 of the drawings.

Figure 6:
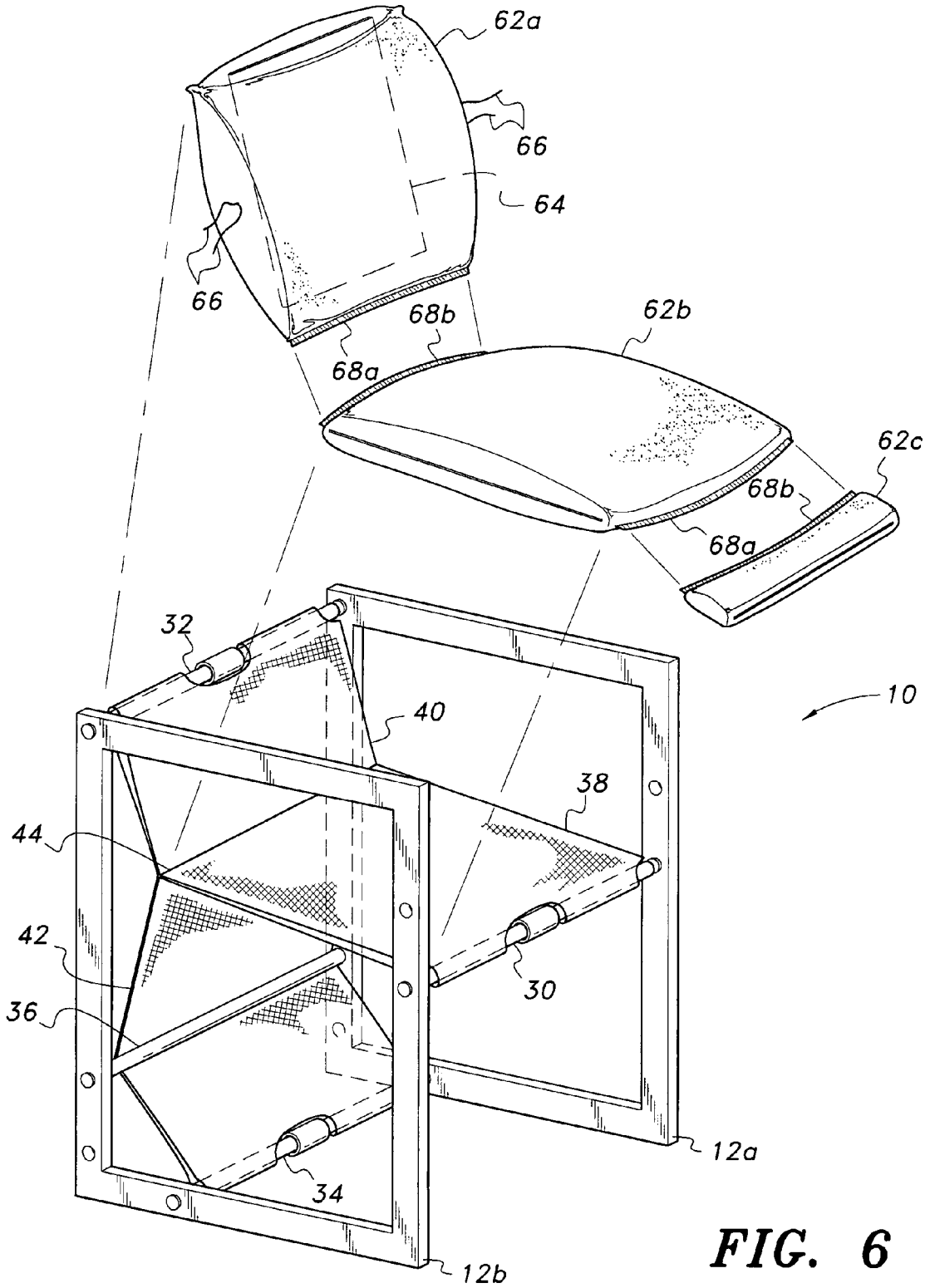
FIG. 6 is an exploded perspective view of optional cushions that may be removably attached to and used with the adjustable configuration seating of the present invention with the seating in an upright orientation.

The adjustable configuration seating, in its various embodiments, provides a quite comfortable, compactly storable, and versatile seating arrangement. Even more comfort may be achieved by providing one or more cushions, which not only cushion the seating, but may also add some additional support as well. FIG. 6 provides an exploded perspective view of such cushioning, applied to the upright seating configuration of FIGS. 1 and 4. Three cushions 62*a*, 62*b*, and 62*c* are provided, with a thin, rigid panel 64 shown in broken lines within the first cushion 62*a*. The rigid panel 64 may be included optionally in the other cushions 62*b* and 62*c* as well, if so desired. The rigid panel 64 provides additional support when a larger cushion is cantilevered to extend beyond the panel retaining crossmember between the edges of the frame members, as would be the case with the larger first cushion 62*a* when placed against the back panel 40. The cushion 62*a* also includes a pair of ties 66 or the like (e.g., hook and loop fastener straps, snaps, etc.) for removably securing the cushion 62*a* to the sides of the two frame members 12*a* and 12*b*.

The ties 66 or the like enable the entire assembled series of cushions 62*a* through 62*c* to be flipped over from one side of the seating surface to the other when the seating unit is converted from one configuration to the other. Alternatively, the cushion 62*a* may be equipped with a pair of crossmember attachment loops, e.g. loops 50 as shown with the single cushion 46 of FIGS. 1 through 3. The configuration of the cushion assembly 62*a* through 62*c* results in the smallest cushion 62*c* extending beyond the crossmember 30 when the seating is in its most upright position, as shown in FIG. 6, with both cushions 62*b* and 62*c* resting atop the longer opposite seating surface 42 when the seating is in its lower, more reclined configuration. Another alternative allows the cushions 62*b* and 62*c* to be removed from the cushion 62*a*, and the single separate cushion 62*a* to be flipped from one side of the backrest to the other during conversion of the seating.

Each cushion 62*a* through 62*c* also preferably includes some means for securing the cushions to one another along their mating edges. For example, the mating edges of the cushions may be provided with mating zipper teeth, e.g., 68*a* along one edge of the first cushion 62*a* and 68*b* along the mating edge of the second cushion 62*b*. The opposite edge of the second cushion 62*b* may be provided with zipper teeth or other attachment means 68*a* identical to the attachment 68*a* of the first cushion 62*a*, with the third cushion 62*c* having attachment means 68*b* along a mating edge. In this manner, two or more such cushions may be assembled together as desired, with the first cushion 62*a* attaching directly to the third cushion 62*c*, or other arrangements or configurations as desired.

The cushion assemblies may also be reversed to place the cushions in the opposite order from that shown in FIG. 6, if so desired, depending upon the configuration of the seating assembly 10. When the cushions 62*a* through 62*c* are secured to one another as shown in FIG. 6 of the drawings, the smaller cushion 62*c* depends over or covers the crossmember 30, depending upon the chair configuration, thereby providing additional comfort for the user of the chair. Many other cushion configurations are possible, limited only in accordance with the desires of the user.

For example, the smaller cushion 62*c* may be used separately as a lumbar support in either seating configuration. Alternatively, the smaller cushion 62*c* may be secured to the intermediate or back cushion 62*a*, and folded over to double the thickness of the two cushions 62*a* and 62*c* along one edge thereof. The smaller cushion 62*c*, when placed along the upper edge of the back cushion 62*a* in this manner, serves as an upper shoulder or neck support, particularly when the seating is in the reclining configuration. Another alternative is the placement of the seat cushion 62*b* along the backrest area, for additional back support. The smaller cushion may be attached to the seat cushion 62*b* and used in the manner described immediately above, if so desired. It should be noted that the above described cushion arrangements are not limiting, but are merely examples of a vast array of configurations and arrangements that may be formed.

Figure 7:
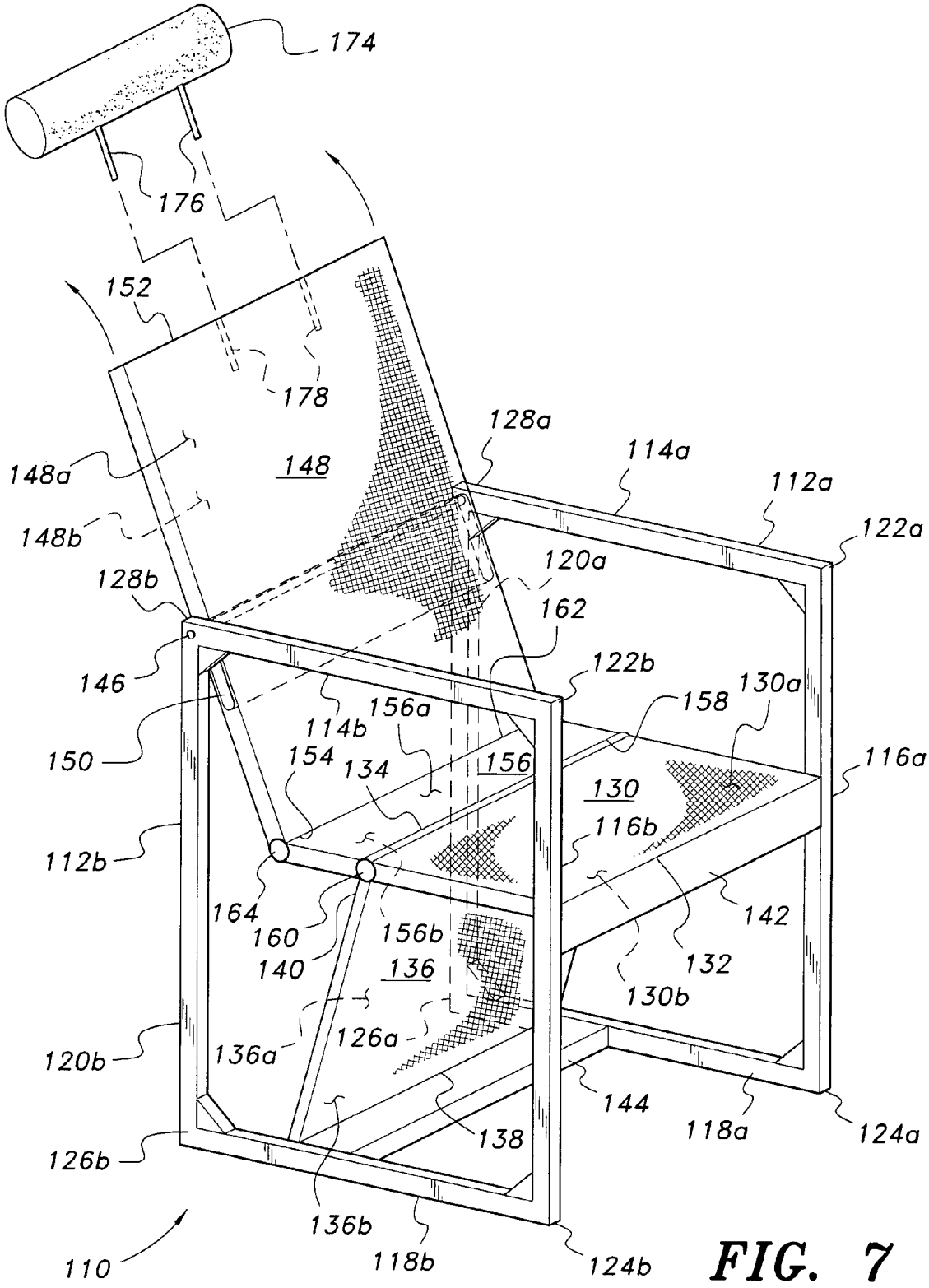
FIG. 7 is a perspective view of another embodiment of the adjustable configuration seating according to the present invention incorporating rigid panels, with the chair shown in an upright position and an optional headrest shown exploded therefrom.

FIGS. 7 through 15B show additional embodiments of adjustable configuration seating. FIGS. 7 through 10 illustrate an adjustable configuration seat 110 and its conversion from a first seating configuration to a second seating configuration. FIG. 7 of the drawings illustrates the adjustable configuration seating 110 in its generally upright seating configuration. The seat or chair 110 includes laterally opposed first and second rigid lateral frame members 112*a* and 112*b*, respectively, having the same general configuration as the lateral frame members 12*a* and 12*b* of the seating 10 of FIGS. 1 through 6. The two lateral frame members 112*a* and 112*b* are each rigid, non-foldable units which retain their shapes at all times; no folding or articulation is provided for either of the lateral frame members 112*a* and 112*b*, *per se*. While the two frame members 112*a* and 112*b* are shown as having open rectangular configurations, it will be seen that these two frame members may comprise continuous panels having closed interior areas, if so desired. The interiors of the frame member peripheries 112*a* and 112*b* may be closed by solid, rigid structure, or covered by fabric or other non-structural material.

Each frame member 112*a*, 112*b* includes four sides 114*a* through 120*a* for the first frame member 112*a*, and four sides 114*b* through 120*b* for the second frame member 112*b*, respectively. These side members 114*a* through 120*a* and 114*b* through 120*b* define the respective peripheries of the two frame members 112*a* and 112*b*. It will be noted that the sides 114*a*, 114*b* and 118*a*, 118*b* are somewhat shorter than the sides 116*a*, 116*b* and 120*a*, 120*b*.

The sides of each frame member form four corners 122*a* through 128*a* for the first frame member 112*a* and four corners 122*b* through 128*b* for the second frame member 112*b*, respectively. It is not absolutely essential that the corners 122*a* through 128*b* of the frame members have acute corners, as shown in the drawings. The corners may be rounded, beveled, chamfered, etc., as desired. The two frame members 112*a*, 112*b* may be formed of any suitable rigid and sturdy material, e.g., wood, metal, dense plastic, etc., or some composite combination thereof in either solid or hollow tubular form.

A rigid first seating panel 130 extends between the two frame assemblies 112*a* and 112*b*, the rigid seating panel 130 having a first or forward edge 132 extending between the second frame side members 116*a* and 116*b*, an opposite rearward edge 134 disposed generally centrally between the two frame members, a first panel seating surface 130*a*, and a first panel undersurface 130*b* opposite the seating surface 130*a*.

A second rigid seating panel 136 also extends between the two frame assemblies 112*a* and 112*b*, the second rigid seating panel 136 having a first or forward edge 138 extending between the second frame members 118*a* and 118*b*, an opposite rearward edge 140 disposed generally centrally between the two frame members and immovably affixed to the rearward edge 134 of the first rigid seating panel 130 along a seating panel joint, a second panel seating surface 136*a*, and a second panel undersurface 136*b* opposite the seating surface 136*a*.

It should be noted that one or the other of the "forward edges" 132 or 138 of the two seating panels 130 and 136 is disposed forwardly when the chair or seating 110 is oriented to position the respective seating panel 130 or 136 as a seating surface, e.g., the first edge 132 of the first seating panel 130 is oriented forwardly in the seating configuration shown in FIG. 7. Each seating panel 130, 136 preferably has a relatively wide or thick crossmember 142 and 144, respectively, disposed along their respective first or forward edges 132 and 138 between the two frame members 112*a* and 112*b*. It will be understood that the two rigid seating panels 130 and 136 are immovably affixed between the two frame members 112*a* and 112*b* due to the fixed attachment of the first or forward edge 132 of the first seating panel 130 between the two frame member sides 116*a* and 116*b* and the fixed attachment of the first or forward edge 138 of the second seating panel 136 between the two frame member sides 118*a* and 118*b*.

A back panel crossmember 146 extends between the fourth corners 128*a*, 128*b* of the two frame members 112*a* and 112*b*. The crossmember 146 preferably comprises a rigid rod or the like to support a rigid back panel 148 adjustably thereon. The back panel 148 includes a lateral slot 150 formed therethrough, the crossmember 146 passing through the slot 150 to capture the back panel 148 adjustably upon the crossmember 146 and between the two lateral frame members 112*a* and 112*b*. The back panel 148 further includes an upper edge 152, an opposite lower edge 154, and opposite first and second backrest surfaces 148*a* and 148*b*, respectively.

The back panel 148 is not directly connected to the fixed joint defined by the second or rear edges 134 and 140 of the two seating panels 130 and 136. Rather, a rigid intermediate panel 156 extends between the rear or joint edges 134 and 140 of the two seating panels 130 and 136 and the lower edge 154 of the back panel 148. The intermediate panel 156 includes mutually opposed first and second seating surfaces 156*a* and 156*b*, respectively, a forward edge 158 pivotally connected to the joint edges 134, 140 of the two seating panels 130, 136 by a seat panel hinge 160, and an opposite rearward edge 162 pivotally connected to the lower edge 154 of the back panel 148 by a back panel hinge 164.

The adjustable configuration seating 110 is adjusted between the relatively upright orientation shown in FIG. 7 to the semi-reclining orientation shown in FIG. 10 in accordance with the intermediate illustrations of FIGS. 8 and 9 and the description provided immediately below. It will be noted that the two lateral frame members 112*a*, 112*b* are at least generally rectangular in shape, with the two opposite sides 116*a*, 120*a* and 116*b*, 120*b* being longer than their respective sides 114*a*, 118*a* and 114*b*, 118*b*. This results in the chair or seating 110 having a relatively upright orientation or configuration when it is resting upon the shorter sides 118*a*, 118*b* of the frame members 112*a*, 112*b*, as shown in FIG. 7.

The seating configuration shown in FIG. 7 also shows the backrest panel 148 slid down to its lowermost position on the back panel crossmember 146, this position of the back panel being limited by the upper edge of the slot 150 contacting the back panel crossmember 146. This results in the intermediate panel 156 being lowered to a position essentially coplanar with the first seating panel 130 shown in FIG. 7 to provide a full seat portion comprising the first seat panel 130 and substantially, or at least generally, coplanar intermediate panel 156. The generally horizontal orientation of the intermediate panel 156 results in the lower edge 154 of the back panel 148 being positioned only slightly forwardly of the back panel crossmember 146, thereby positioning the back panel to a generally vertical orientation with only a slight reclining angle.

Figure 8:
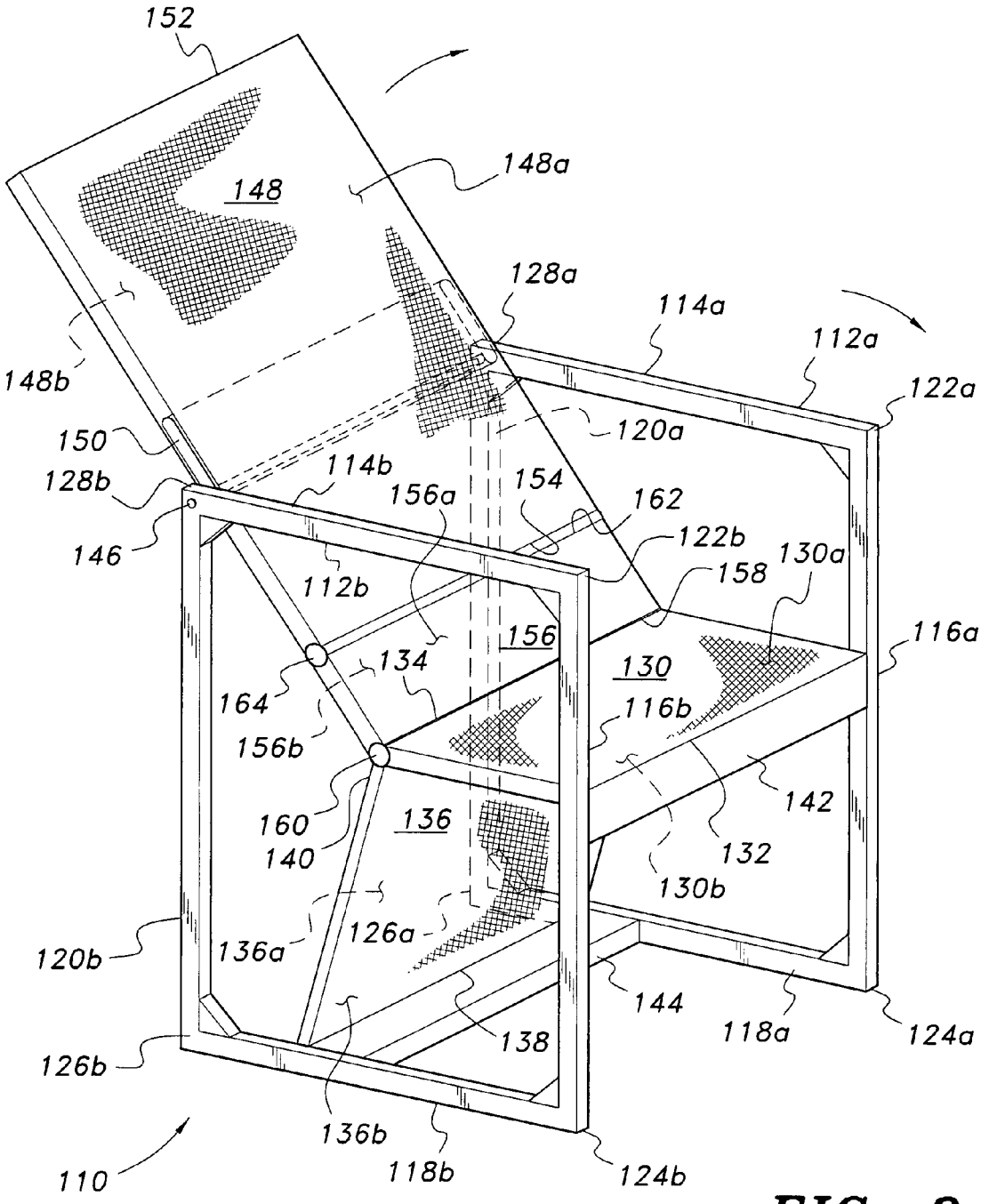
FIG. 8 is a perspective view of the adjustable configuration seating of FIG. 7 in an intermediate or transition configuration.

In FIG. 8, the back panel 148 has been drawn upward about the back panel crossmember 146, with the lower edge of the slot 150 adjacent the crossmember 146. The hinged connection of the lower edge 154 of the back panel 146 to the intermediate panel 156 results in the intermediate panel pivoting upwardly relative to the first seating panel 130 for alignment generally coplanar with the back panel 148. This is an intermediate configuration between the upright seating position shown in FIG. 7 and the semi-reclining position shown in FIG. 10.

Figure 9:
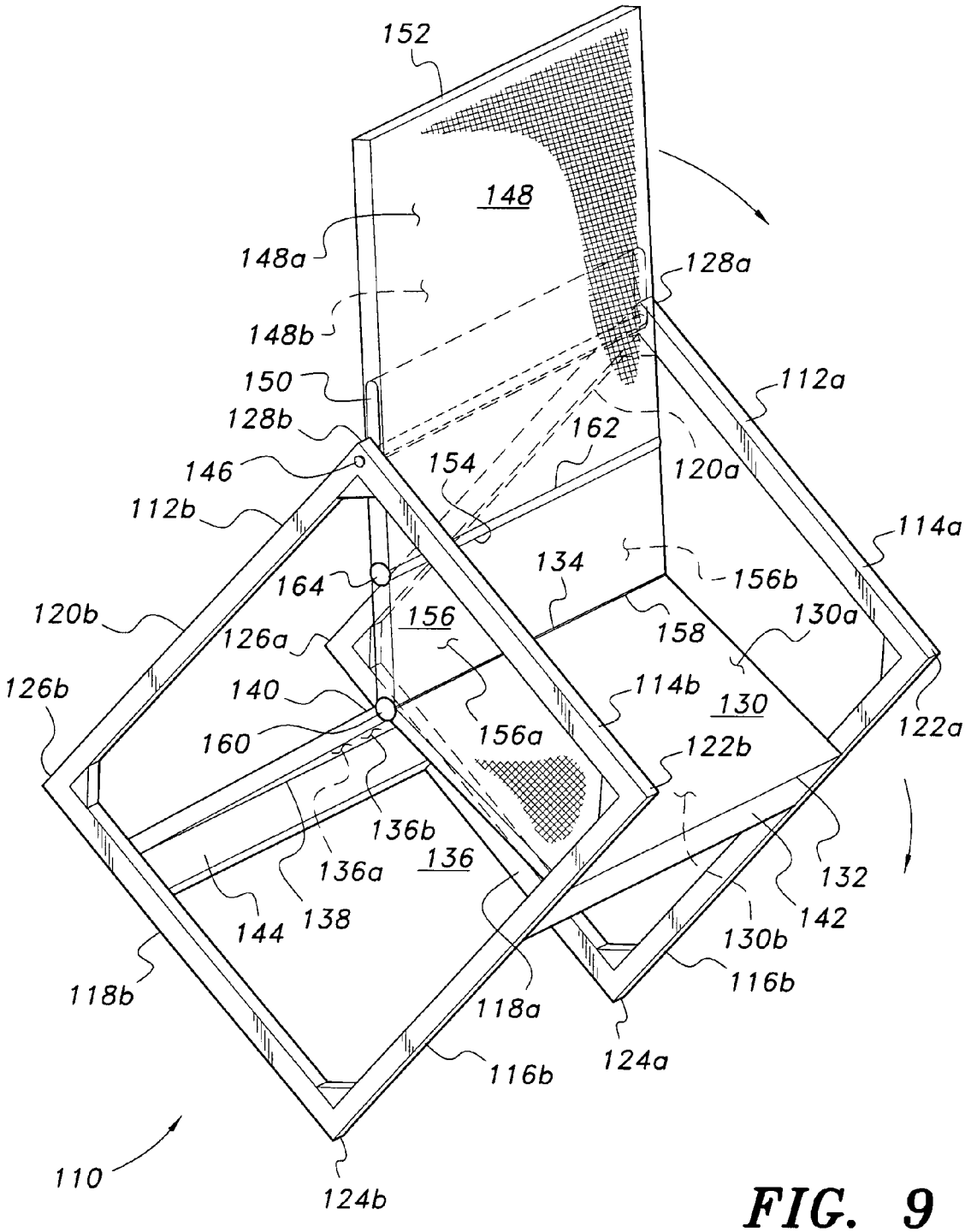
FIG. 9 is a perspective view of the adjustable configuration seating of FIG. 8, rotated forty-five degrees between its upright and reclining configurations.
Figure 10:
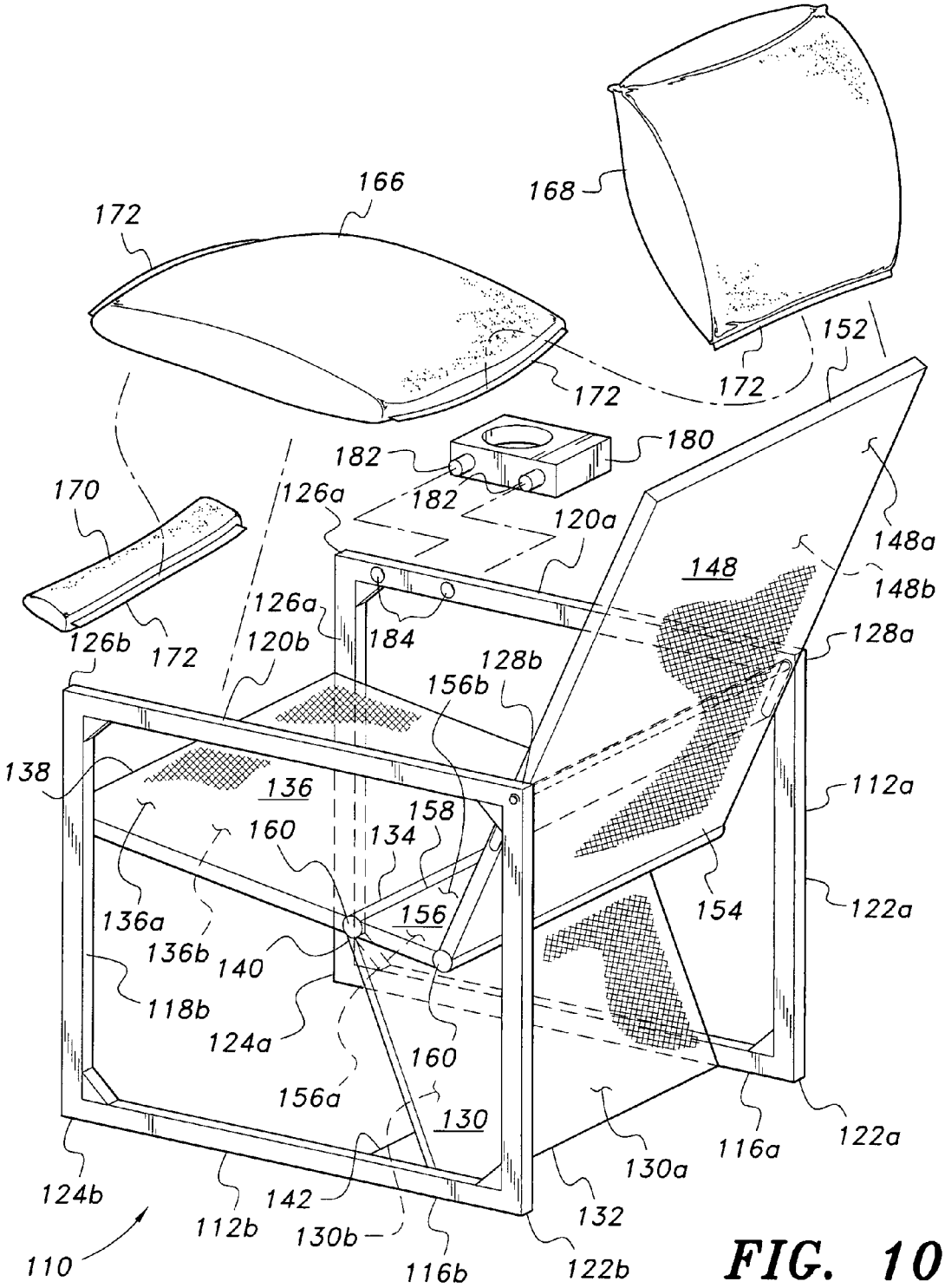
FIG. 10 is a perspective view of the reclining configuration of the adjustable configuration seating of FIGS. 7 through 9 reconfigured to a second seating configuration, also showing an optional removably attachable armrest accessory and cushions exploded therefrom.

In FIG. 9 the chair or seating 110 has been tipped forwardly by about forty-five degrees, or about halfway between the upright orientation of FIG. 7 and the semi-reclining orientation of FIG. 10. The chair or seat configuration is otherwise as shown in FIG. 8, with the backrest panel 148 drawn upwardly to pull the intermediate panel 156 into general alignment with the backrest panel.

FIG. 10 provides an illustration of the completion of the change to a semi-reclining configuration. It will be seen in FIG. 10 that the chair or seating 110 has been rotated by another forty-five degrees from the position shown in FIG. 9, so the seating 110 is resting upon the longer horizontal sides 116*a* and 116*b* of the two lateral frame members 112*a* and 112*b*. This allows the back panel 148 to drop downwardly over its restraining crossmember 146, the upper edge of the slot 150 resting upon the crossmember. The slot 150 is positioned and dimensioned through the back panel 148 to position the intermediate panel 156 in at least a generally coplanar orientation with the second seating panel 136, as shown in FIG. 10. The longer horizontal span of the lateral frame members 112*a* and 112*b* in this orientation results in the lower edge 154 of the back panel 148 being positioned somewhat farther forwardly of the crossmember 146 than is the case in the upright seating configuration shown in FIG. 7, thereby positioning the backrest panel 148 at a somewhat shallower angle for a more reclined seating position. The first seating surface 136*a* of the second seat panel 136 becomes the seat bottom surface in this configuration, with the second back panel surface 148*b* becoming the seat back surface.

Greater comfort may be provided by the placement of one or more removable cushions upon the hard or rigid panels 130, 136, 148, and 156. A plurality of such cushions, comprising a seat cushion 166, a backrest cushion 168, and a panel crossmember or crossbar cushion 170, are illustrated in FIG. 10 of the drawings. The various cushions 166 through 170 preferably include mating attachment edges 172 extending therefrom (e.g., zippers, Velcro®, snaps, etc.) allowing the cushions to be removably attached to one another and/or to the various seating surfaces of the chair or seat 110. While the various cushions 166 through 170 are shown above or adjacent to the second seating and backrest surfaces 136*a* and 148*b* in FIG. 10, it will be seen that they may be applied to the opposite first seating and backrest surfaces 130*a* and 148*a* when the chair or seating 110 is in its more upright position as shown in FIG. 7.

Additional comfort and convenience may be provided by a detachable headrest cushion 174 (FIG. 7). The headrest cushion 174 includes one or more pins 176, which install removably within mating receptacles 178 formed in the upper portion of the back panel 148. Additional accessories, e.g., a cup holder or ashtray 180, etc., may be removably installed upon the chair or seating structure 110, as shown in FIG. 10. The armrest accessory attachment 180 may be removably secured to either of the lateral frame members 112*a* or 112*b* by one or more pins or rods 182 extending from the accessory 180 to engage mating receptacles 184 provided in the frame member (s) 112*a* and/or 112*b*. While only a single set of accessory receptacles 184 are illustrated in the fourth side 120*a* of the first lateral frame member 112*a* in FIG. 10, it will be seen that such receptacles could be formed in the opposite frame member 112*b* and/or in either of the first side components 114*a* and/or 114*b* forming the armrests of the seat 110 when it is in its upright seating position, as shown in FIG. 7.

FIGS. 11 through 14 show an additional embodiment of the adjustable configuration seating, designated as seating or chair 210. The seating 210 is quite similar to the seating 110 of FIGS. 7 through 10, with the exception of the intermediate panel between the two seating panels and the attachment of the back panel between the two lateral frame members. Accordingly, the corresponding reference numerals are used for corresponding components between the two seats or chairs 110 and 210, with reference numerals for the chair 210 having second and third place digits identical to those digits for corresponding components of the chair 110.

Figure 11:
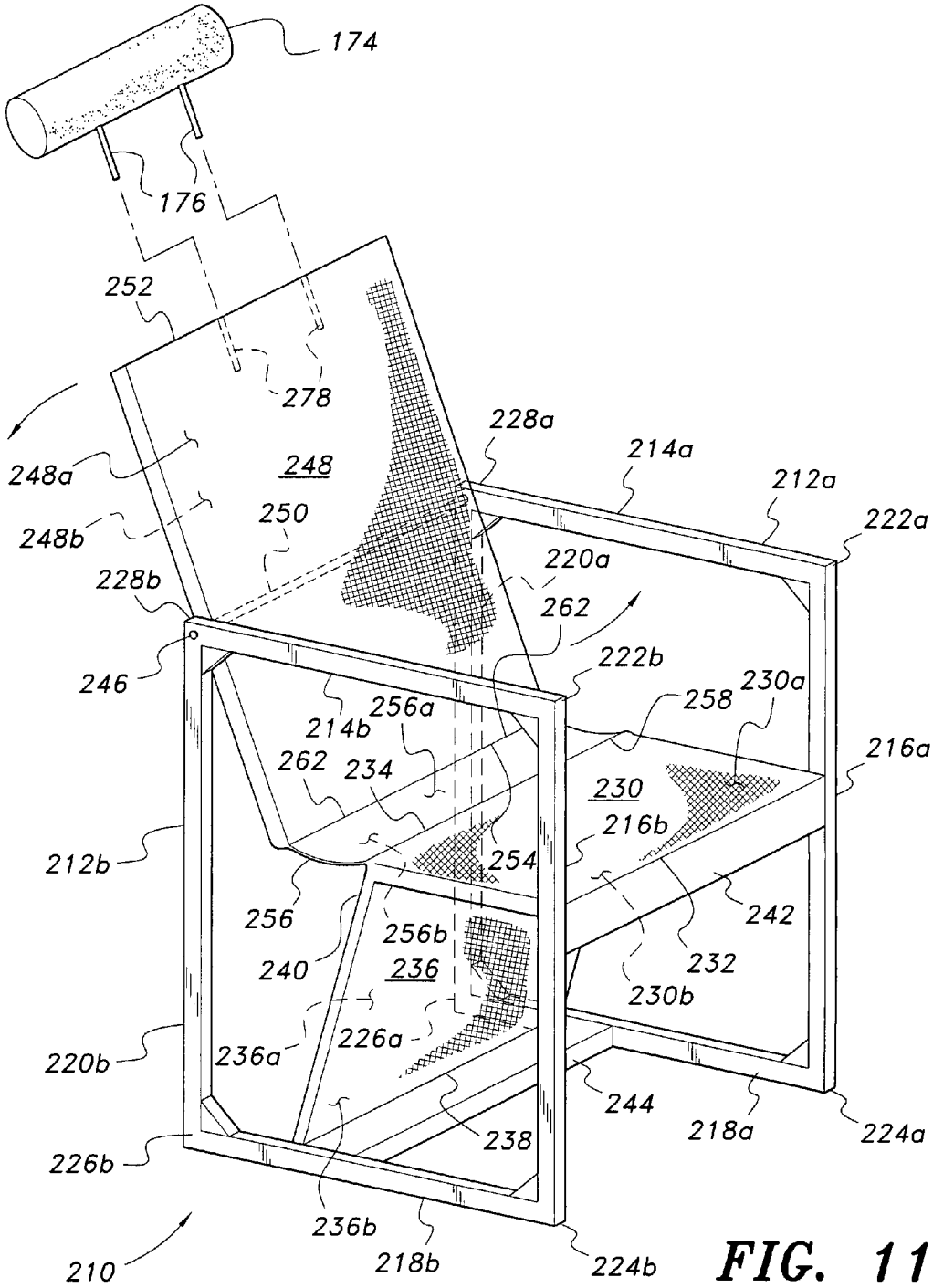
FIG. 11 is a perspective view of another embodiment of the adjustable configuration seating according to the present invention incorporating a flexible intermediate panel between a rigid seat panel and rigid backrest panel, with the chair shown in an upright position and an optional headrest shown exploded therefrom.

FIG. 11 of the drawings illustrates the adjustable configuration seating embodiment 210 in its generally upright seating configuration. The seat or chair 210 includes laterally opposed first and second rigid lateral frame members 212*a* and 212*b*, respectively, having the same general configuration as the lateral frame members 112*a* and 112*b* of the seating 110 of FIGS. 7 through 10. The two lateral frame members 212*a* and 212*b* are each rigid, non-foldable units that retain their shapes at all times. No folding or articulation is provided for either of the lateral frame members 212*a* and 212*b*, *per se*. While the two frame members 212*a* and 212*b* are shown as having open rectangular configurations, it will be seen that these two frame members may comprise continuous panels having closed interior areas. The interiors of the frame member peripheries 212*a* and 212*b* may be closed by solid, rigid structure, or covered by fabric or other non-structural material.

Each frame member 212*a*, 212*b* includes four sides 214*a* through 220*a* for the first frame member 212*a*, and 214*b* through 220*b* for the second frame member 212*b*, respectively. These side members 214*a* through 220*a* and 214*b* through 220*b* define the respective peripheries of the two frame members 212*a* and 212*b*. It will be noted that the sides 214*a*, 214*b* and 218*a*, 218*b* are somewhat shorter than the sides 216*a*, 216*b* and 220*a*, 220*b*. The sides of each frame member form four corners 222*a* through 228*a* for the first frame member 212*a* and 222*b* through 228*b* for the second frame member 212*b*, respectively. It is not absolutely essential that the corners 222*a* through 228*b* of the frame members be acute corners, as shown in the drawings. The corners may be rounded, beveled, chamfered, etc. The two frame members 212*a*, 212*b* may be formed of any suitable rigid and sturdy material, e.g., wood, metal, dense plastic, etc., or some composite combination thereof in either solid or hollow tubular form.

A rigid first seating panel 230 extends between the two frame assemblies 212*a* and 212*b*, the rigid seating panel 230 having a first or forward edge 232 extending between the second frame side members 216*a* and 216*b*, an opposite rearward edge 234 disposed generally centrally between the two frame members, a first panel seating surface 230*a*, and a first panel undersurface 230*b* opposite the seating surface 230*a*.

A second rigid seating panel 236 also extends between the two frame assemblies 212*a* and 212*b*, the second rigid seating panel 236 having a first or forward edge 238 extending between the second frame members 218*a* and 218*b*, an opposite rearward edge 240 disposed generally centrally between the two frame members and immovably affixed to the rearward edge 234 of the first rigid seating panel 230 along a seating panel joint, a second panel seating surface 236*a*, and a second panel undersurface 236*b* opposite the seating surface 236*a*.

It should be noted that one or the other of the "forward edges" 232 or 238 of the two seating panels 230 and 236 is disposed forwardly when the chair or seating 210 is oriented to position the respective seating panel 230 or 236 as a seating surface, e.g., the first edge 232 of the first seating panel 230 is oriented forwardly in the seating configuration shown in FIG. 11. Each seating panel 230, 236 preferably has a relatively wide or thick crossmember 242 or 244, respectively, disposed along their respective first or forward edges 232 and 238 between the two frame members 212*a* and 212*b*. It will be understood that the two rigid seating panels 230 and 236 are immovably affixed between the two frame members 212*a* and 212*b* due to the fixed attachment of the first or forward edge 232 of the first seating panel 230 between the two frame member sides 216*a* and 216*b*, and the fixed attachment of the first or forward edge 238 of the second seating panel 236 between the two frame member sides 218*a* and 218*b*.

A back panel crossmember 246 extends between the fourth corners 228*a*, 228*b* of the two frame members 212*a* and 212*b*. The crossmember 246 preferably comprises a rigid rod or the like to support a rigid back panel 248 adjustably thereon. The back panel 248 of the embodiment 210 of FIGS. 11 through 14 differs from the back panel 148 of the embodiment 110 of FIGS. 7 through 10. The back panel 248 includes a lateral passage 250 formed therethrough dimensioned to fit closely about the crossmember 246, rather than a slot allowing the panel to slide longitudinally about the crossmember, as in the case of the seat 110 of FIGS. 7 through 10. The back panel 248 has an upper edge 252, an opposite lower edge 254, and opposite first and second backrest surfaces 248*a* and 248*b*, respectively.

The crossmember 246 of the embodiment 210 of FIGS. 11 through 14 passes through the passage 250 to capture the back panel 248 pivotally upon the crossmember 246 and between the two lateral frame members 212*a* and 212*b*. No longitudinal movement of the back panel 248 relative to the remainder of the structure is permitted in this embodiment. Alternatively, the crossmember 246 could pivot within the two opposed corner portions 228*a* and 228*b* of the opposite frame members 212*a* and 212*b*, with the back panel 248 being immovably affixed to the crossmember 246. Another alternative would be to provide relatively short pins extending inwardly from each corner portion 228*a* and 228*b* of the frame members, the pins engaging mating receptacles in the opposite lateral edges of the back panel 248. However, it is preferred that the crossmember 246 comprise a single, continuous rod or the like immovably affixed between the two frame members 212*a* and 212*b* for greater rigidity and strength for the complete structure.

The back panel 248 is not directly connected to the fixed joint defined by the second or rear edges 234 and 240 of the two seating panels 230 and 236. Rather, a flexible intermediate panel 256 (e.g., coated or non-coated fabric; relatively thin, flexible plastic sheet material, webbing or mesh, etc.) extends between the rear or joint edges 234 and 240 of the two seating panels 230 and 236 and the lower edge 254 of the back panel 248. The flexible intermediate panel 256 includes mutually opposed first and second seating surfaces 256*a* and 256*b*, respectively, a forward edge 258 flexibly attached to the joint edges 234, 240 of the two seating panels 230, 236, and an opposite rearward edge 262 flexibly attached to the lower edge 254 of the back panel 248.

The adjustable configuration seating 210 is adjusted between the relatively upright orientation shown in FIG. 11 to the semi-reclining orientation shown in FIG. 14 in accordance with the intermediate illustrations of FIGS. 12 and 13 and the description provided immediately below. It will be noted that the two lateral frame members 212*a*, 212*b* are at least generally rectangular in shape, the two opposite sides 216*a*, 220*a* and 216*b*, 220*b* being longer than their respective sides 214*a*, 218*a* and 214*b*, 218*b*. This results in the chair or seating 210 having a relatively upright orientation or configuration when it is resting upon the shorter sides 218*a*, 218*b* of the frame members 212*a*, 212*b*, as shown in FIG. 11.

The seating configuration shown in FIG. 11 also shows the backrest panel 248 pivoted or positioned at a relatively steep slope approaching the vertical on the back panel crossmember 246, with this position of the back panel being limited by the span of the intermediate flexible panel 256 extending between the joint between the two seating panels 230 and 236 and the lower edge 254 of the back panel 248. This results in the intermediate panel 256 being extended to an essentially coplanar orientation relative to the first seating panel 230, as shown in FIG. 11, to provide a full seat portion comprising the first seat panel 230 and substantially, or at least generally, coplanar intermediate panel 256. The generally horizontal orientation of the intermediate panel 256 results in the lower edge 254 of the back panel 148 being positioned only slightly forwardly of the back panel crossmember 246, thereby positioning the back panel to a generally vertical orientation with only a slight reclining angle.

Figure 12:
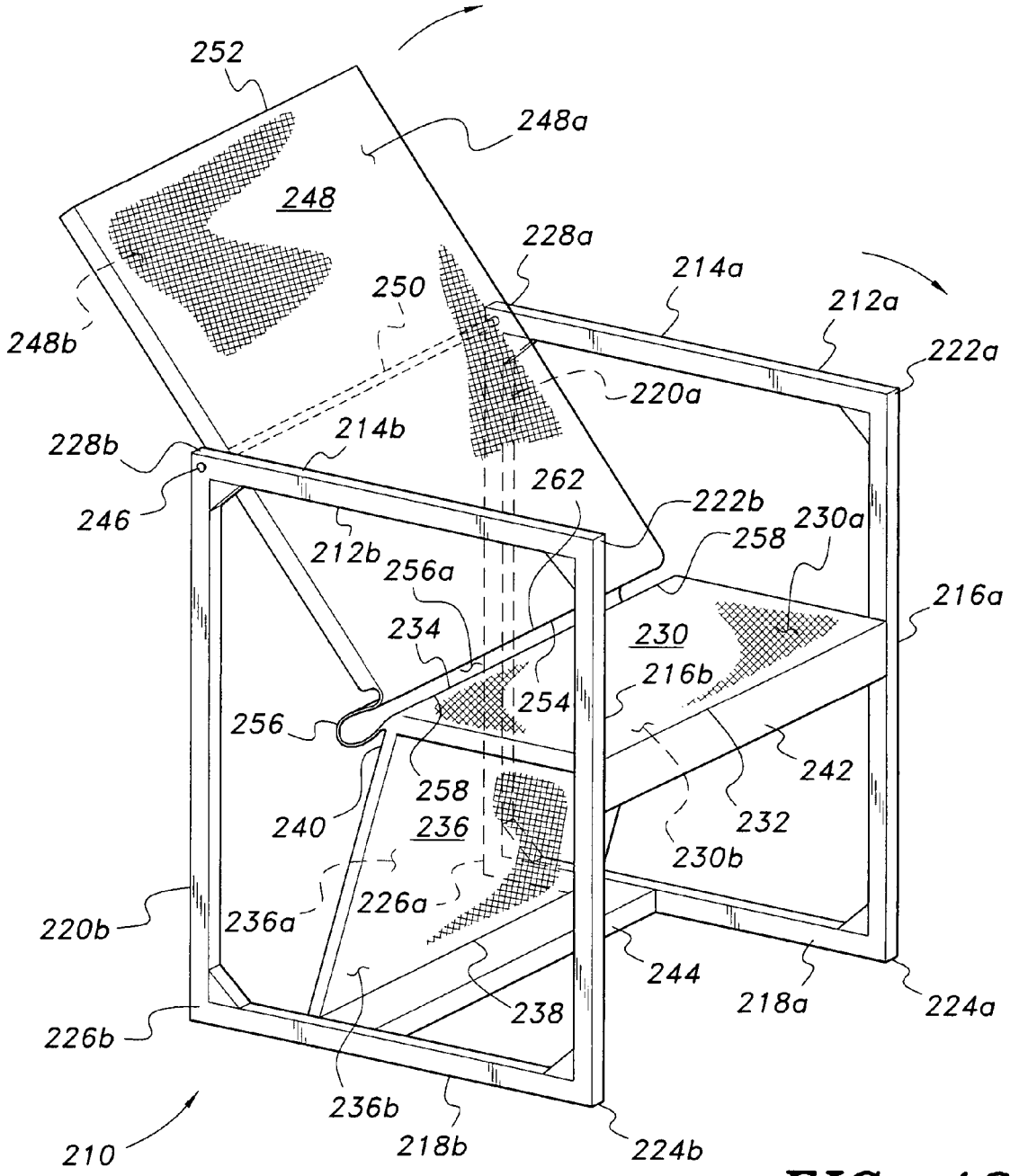
FIG. 12 is a perspective view of the adjustable configuration seating of FIG. 11 in an intermediate or transition configuration.

In FIG. 12, the back panel 248 has been pivoted about the back panel crossmember 246, with the lower edge 254 of the back panel 248 adjacent the rear edge 234 of the first seating panel 230. This results in the intermediate panel 256 flexing or folding together. This is an intermediate configuration between the upright seating position shown in FIG. 11, and the semi-reclining position shown in FIG. 14.

Figure 13:
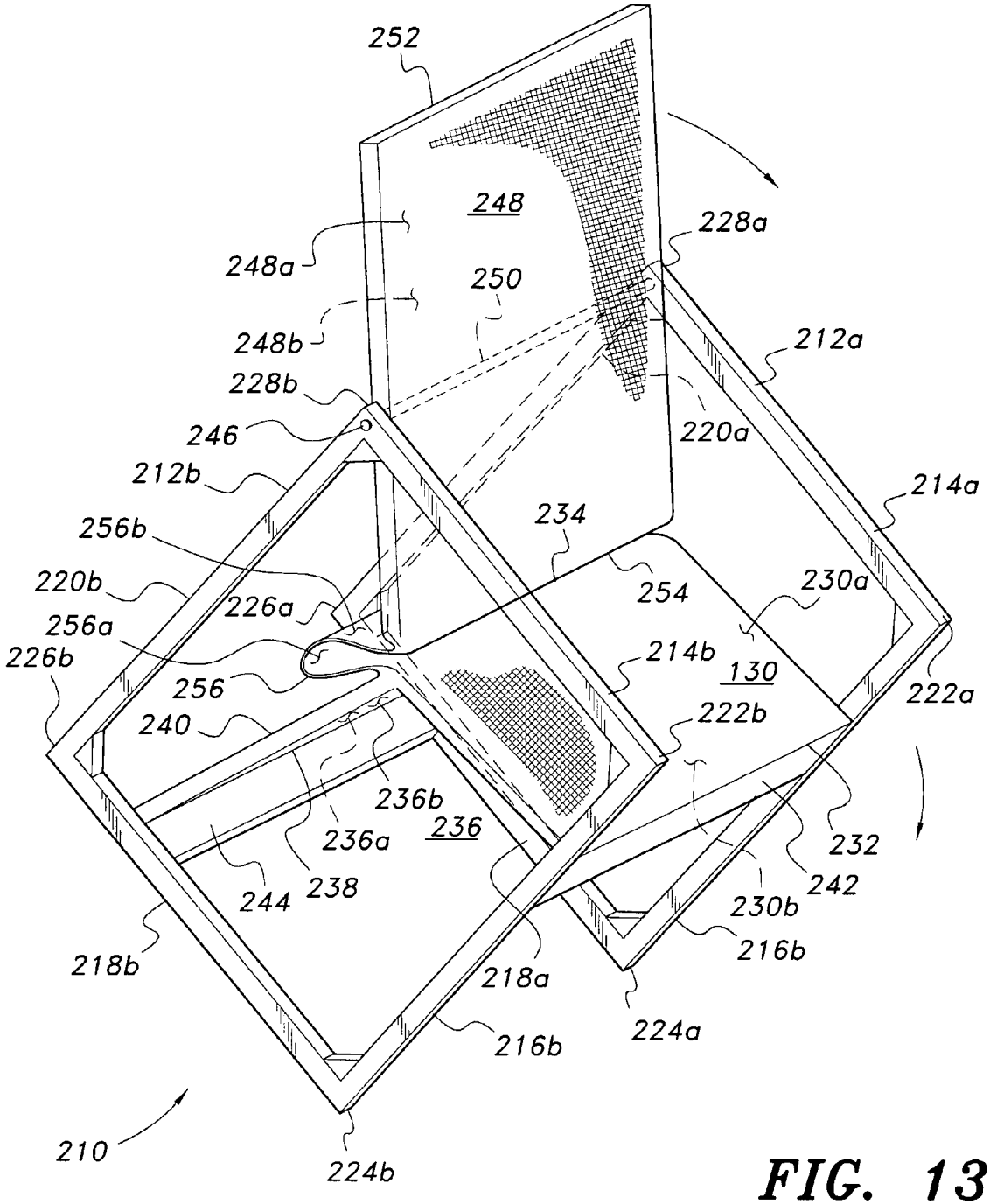
FIG. 13 is a perspective view of the adjustable configuration seating of FIG. 12, rotated forty-five degrees between its upright and reclining configurations.
Figure 14:
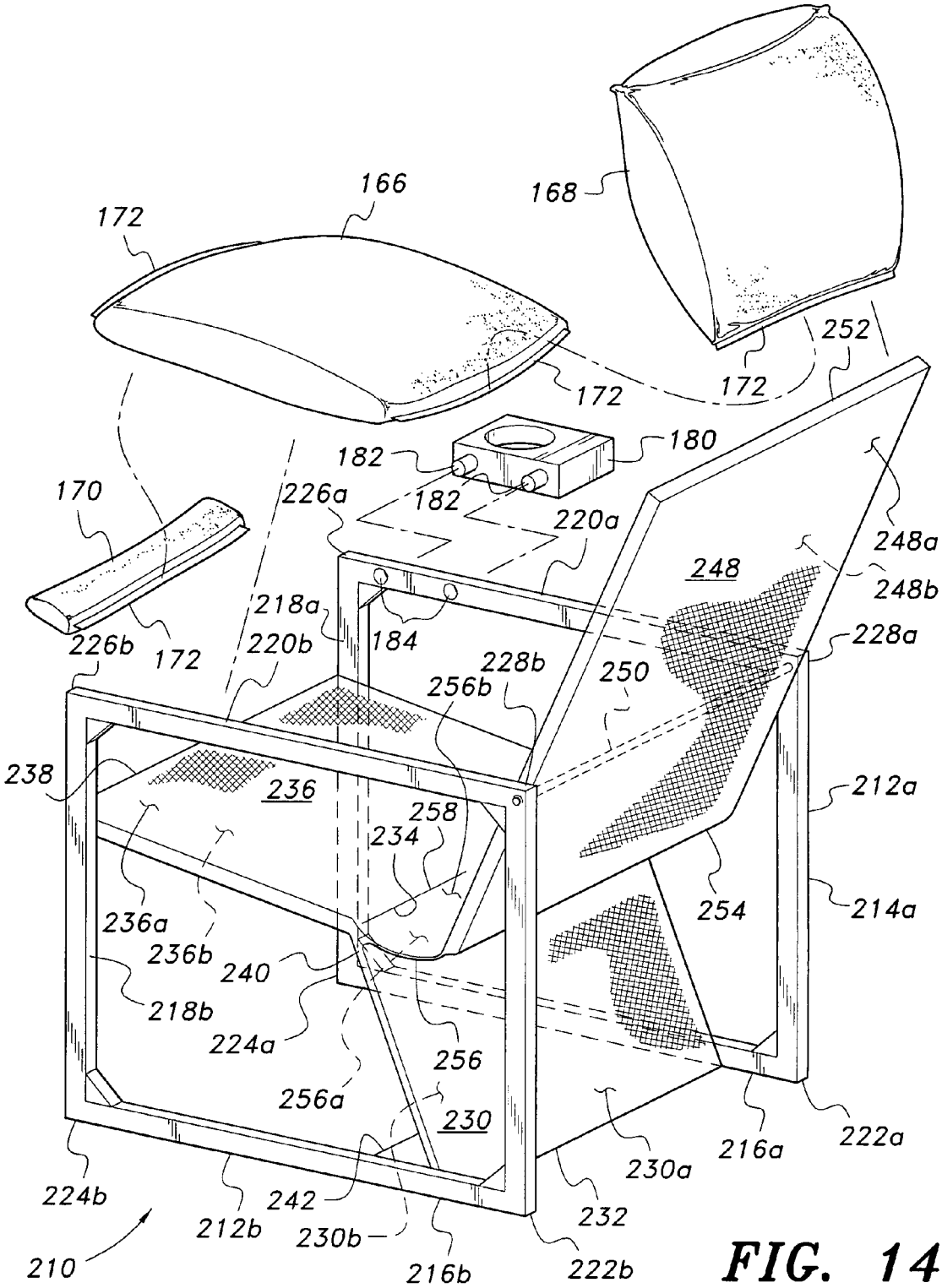
FIG. 14 is a perspective view of the reclining configuration of the adjustable configuration seating of FIGS. 11 through 13, reconfigured to a second seating configuration, and also showing an optional removably attachable armrest accessory and cushions exploded therefrom.

In FIG. 13 the chair or seating 210 has been tipped forwardly by about forty-five degrees, or about half way between the upright orientation of FIG. 11 and the semi-reclining orientation of FIG. 14. The chair or seat configuration is otherwise as shown in FIG. 12, with the backrest panel 248 pivoted to position the lower edge 254 of the back panel 248 adjacent the rear edge 234 of the first seating panel 230, thereby causing the intermediate panel 156 to fold as shown in FIGS. 12 and 13.

FIG. 14 provides an illustration of the completion of the change to a semi-reclining configuration. It will be seen in FIG. 14 that the chair or seating 210 has been rotated by another forty-five degrees from the position shown in FIG. 13, so that the seating 210 is resting upon the longer horizontal sides 216*a* and 216*b* of the two lateral frame members 212*a* and 212*b*. The back panel 248 is pivoted about the crossmember 246 to raise its upper edge 252 to the greatest extent possible, thereby drawing the lower edge 254 of the back panel 248 to extend the flexible intermediate seating panel 256 to form a rearward extension of the second seating panel 236. The longer horizontal span of the lateral frame members 212*a* and 212*b* in this orientation results in the lower edge 254 of the back panel 248 being positioned somewhat farther forwardly of the crossmember 246 than is the case in the upright seating configuration shown in FIG. 11, thereby positioning the backrest panel 248 at a somewhat shallower angle for a more reclined seating position. The first seating surface 236*a* of the second seat panel 236 becomes the seat bottom surface in this configuration, the second back panel surface 248*b* becoming the seat back surface.

The chair or seating embodiment 210 of FIGS. 11 through 14 may make use of cushions to provide greater comfort, as shown in FIG. 14. These cushions 166 through 170 may be essentially identical to the cushions 166 through 170 shown in FIG. 10 of the drawings for the seating 110, and, accordingly, are designated with the same reference numerals. Conventional attachment means 172 (hook and loop, zippers, snaps, etc.) are provided along the mating edges of the cushions for securing the cushions to one another and/or to the seating or chair 210. While the various cushions 166 through 170 are shown above or adjacent to the second seating and backrest surfaces 236*a* and 248*b* in FIG. 14, it will be seen that they may be applied to the opposite first seating and backrest surfaces 230*a* and 248*a* when the chair or seating 210 is in its more upright position as shown in FIG. 11.

A detachable headrest 174 may also be installed to the upper edge 252 of the back panel 248 by means of headrest attachment receptacles or sockets 278 formed in the upper portion of the back panel 248 and mating pins or rods 176 extending from the headrest 174, as shown in FIG. 11 of the drawings. The headrest 174 and its pins or rods 176 are identical to the headrest and pins illustrated in FIG. 7 for the chair or seating embodiment 110, with the same reference numerals being used accordingly.

Additional accessories, e.g., a cup holder or ashtray 180, etc., may be removably installed upon the chair or seating structure 210, as shown in FIG. 14. The armrest accessory attachment 180 may be removably secured to either of the lateral frame members 212*a* or 212*b* by one or more pins or rods 182 extending from the accessory 180 to engage mating receptacles 284 provided in the frame member(s) 212*a* and/or 212*b* in the same manner as described further above for the seating embodiment 110 of FIGS. 7 through 10. As the accessory 180 and its attachment are identical in both embodiments 110 and 210, the same reference numerals are used for the accessory in FIGS. 10 and 14. While only a single set of accessory receptacles 284 are illustrated in the fourth side 220*a* of the first lateral frame member 212*a* in FIG. 14, it will be seen that such receptacles could be formed in the opposite frame member 212*b* and/or in either of the first side components 214*a* and/or 214*b* forming the armrests of the seat 210 when it is in its upright seating position, as shown in FIG. 11.

Figure 15A:
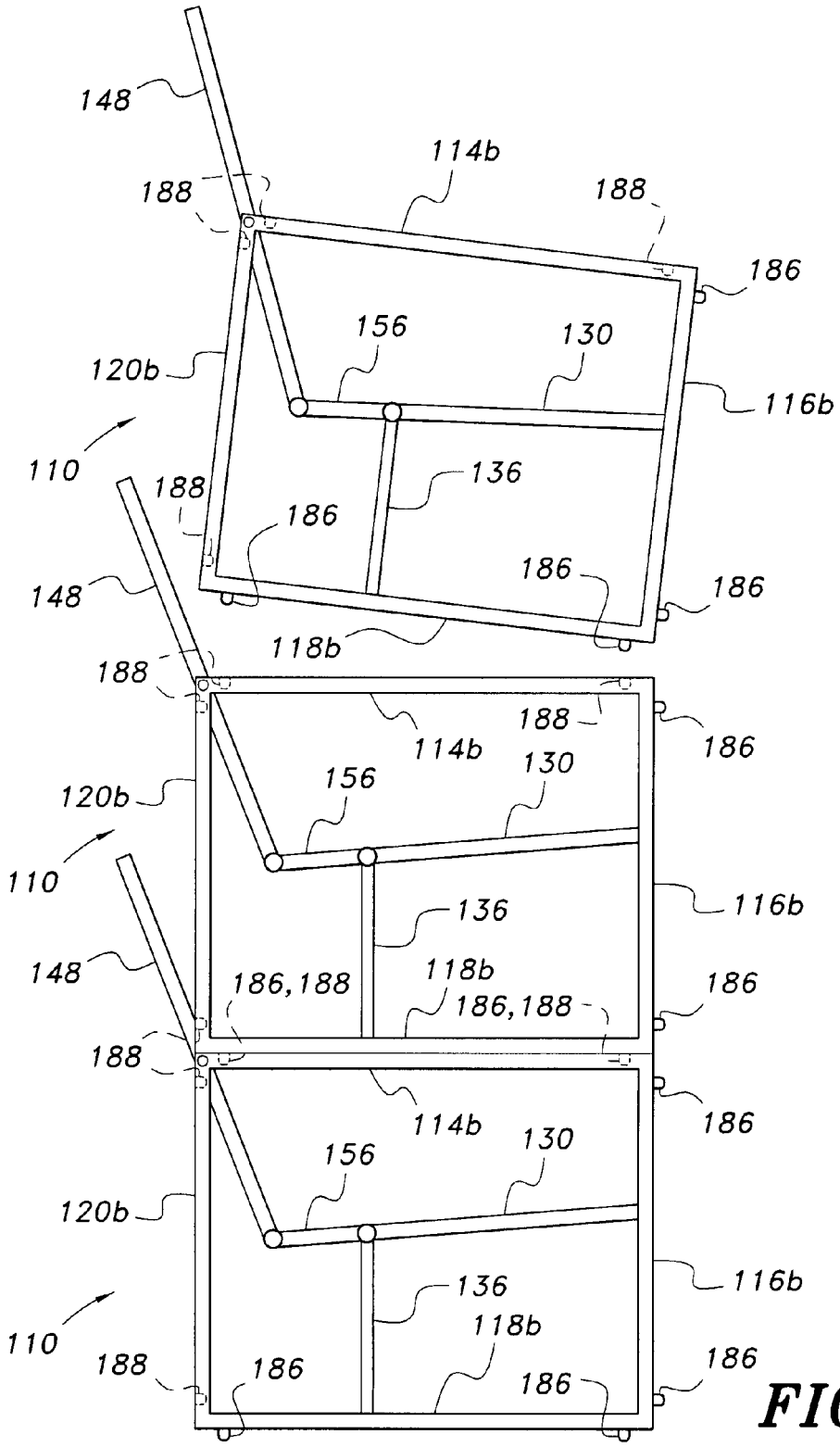
FIG. 15A is a schematic right side elevation view of a first stacking configuration for the embodiments of FIGS. 7-14, with the chairs stacked along the longer edges of their frames.
Figure 15B:
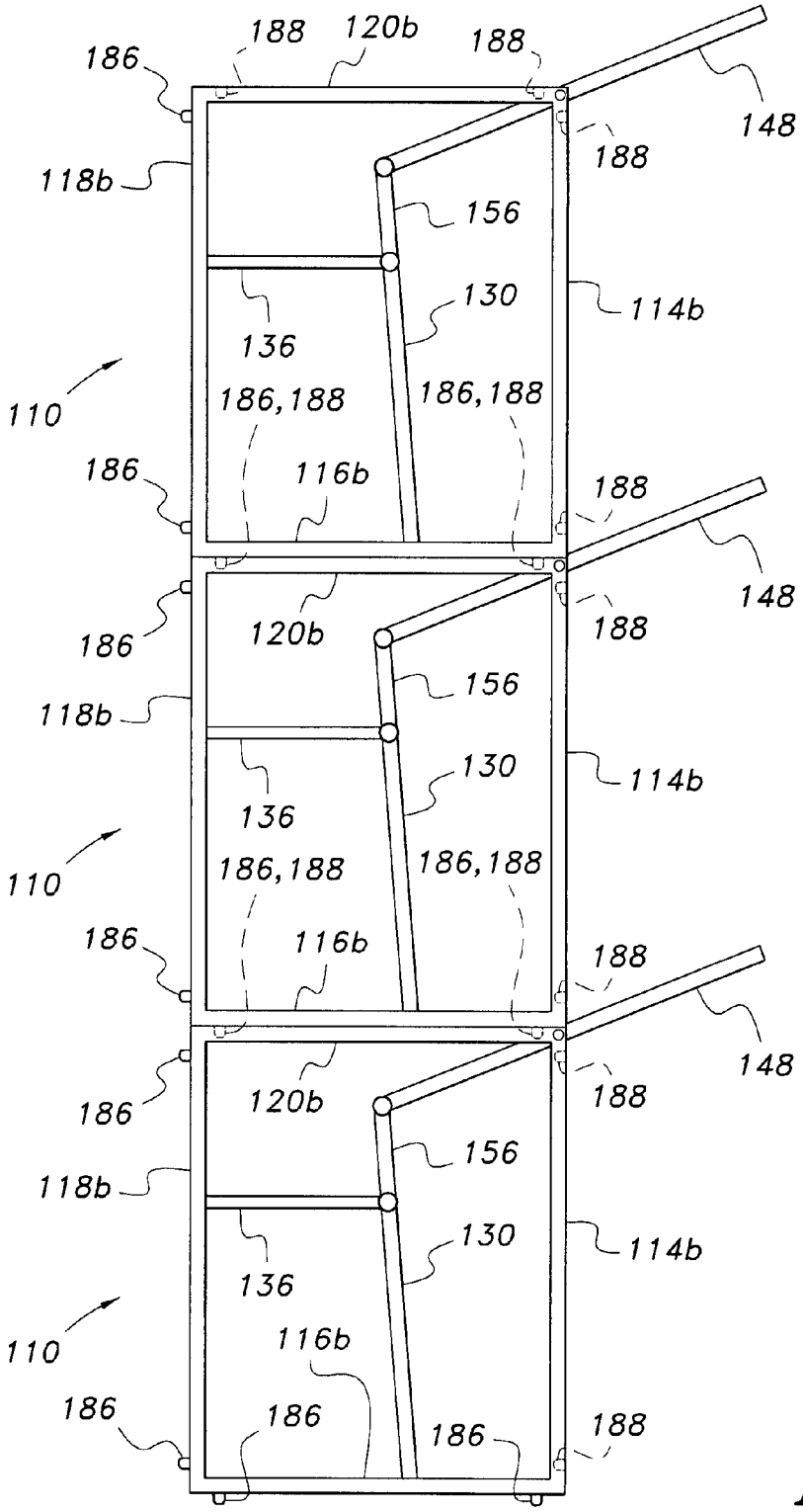
FIG. 15B is a schematic right side elevation view of a second stacking configuration for the embodiments of FIGS. 7-14, with the chairs stacked along the shorter edges of their frames.

The rigid rectangular configuration of the lateral frame members of the various embodiments of the adjustable configuration seating provides for the convenient stacking of a series of such seats or chairs atop one another for storage when the lateral frame members are provided with suitable mutual engagement means. FIGS. 15A and 15B provide illustrations of such stacked chairs or seating. In FIG. 15A, a series of chair or seating embodiments 110 are shown stacked atop one another with their widest frame sides or elements disposed horizontally, with the uppermost chair or seat shown slightly separated from those below. At least two protrusions 186 extend outwardly from the lowermost longer frame side member or element 118*b* of each of the chairs, each uppermost longer frame side member or element 114*b* having corresponding receptacles 188 for engaging the protrusions. It will be understood that the protrusions 186 and receptacles 188 are preferably provided on the corresponding frame side members or elements 114*a* and 114*b* of the left side of the chair, as well as those shown on the right side of the chair in FIG. 15A. The protrusions 186 may comprise relatively hard but resilient plastic or rubber bumpers in order to serve as "feet" for the chair or seating 110 when the chair resting upon a floor or other surface for use.

FIG. 15B shows a series of adjustable configuration seating chairs 110 stacked atop one another with their shorter side elements 116*b* and 120*b* engaging one another. The chairs 110 shown stacked in FIG. 15B are upright in the orientation shown in FIG. 7 of the drawings for more upright or formal seating. Accordingly, a series of protrusions, bumpers, or feet 118 are installed to project from the lowermost shorter or narrower frame element or side 116*b*, with the opposite narrower frame element or side 120*b* having a series of corresponding protrusion-engaging receptacles 188 formed therein. It will be noted that the seating or chairs 110 of both FIGS. 15A and 15B include protrusions 186 disposed upon both the wider and narrower frame side elements 118*b* and 116*b*, with both the wider and narrower frame side elements 114*b* and 120*b* having mating receptacles 188 formed therein. This allows the chairs or seating 110 to be stacked in either orientation shown in FIGS. 15A and 15B, as well as providing bumpers or "feet" for the chairs 110, whether in their more upright, formal seating configuration (FIG. 7) or in their lower, less formal seating configuration (FIG. 10). It will be seen that this protrusion and receptacle arrangement may be provided for any of the other chairs or seating disclosed herein, i.e., the chair 10 of FIGS. 1 through 6 and chair 210 of FIGS. 11 through 14, as well as the seat 110 of FIGS. 7 through 9.

In conclusion, the adjustable configuration seating provides superior versatility for different seating configurations and storage. The seating may be constructed to provide relatively light weight for portability, yet provides a sturdy and solid structure by means of its rigid lateral members. The structure of the present seating is relatively economical, thus providing for use in many environments where large numbers of durable yet comfortable chairs or seating must be provided, e.g., resorts, hotels and motels, etc.

The unique concept that gives one series of embodiments of this seating its ability to convert from use for relaxing, e.g. living room, terrace or poolside, etc., to use for dining or other more upright seating environment, is the precise calculation of the lengths of the three portions of the flexible seating surface in combination with the two precise locations of the tension bar across the assembly. This precise combination of lengths and placements determines the important seat angles and depths of each position for maximum comfort while being used for the desired purpose. For relaxing, the seat back is at a more reclined angle, the seat bottom slopes down at the back, and the depth of the seat is deeper. For dining or other more formal, upright seating, the seat back is more erect, the seat bottom is more horizontal, and the seat depth is shorter.

The adjustable configuration seating provides a change in the height of the seating position due to the rotation of the frame during the configuration change. This provides a higher and more upright seating position compatible with a conventional table or the like, e.g., for dining, desk work or any other situation requiring upright seating, while providing a lower, more reclined seating position and orientation due to the lower frame disposition when the present seat is in its reclining configuration.

The seating will also find favor among dorm students and owners and renters of studio apartments or other small quarters, as the versatility enables the seating to serve dual purposes or functions while requiring no more room than a single small conventional chair. Even greater versatility may be provided by elongating the crossmembers and widening the panel surfaces to provide seating for more than one person, and/or providing additional intermediate frame members for additional support between each seating panel. Accordingly, the present seating in its various embodiments will prove to be extremely popular among a great number of people of different needs and backgrounds.

It is to be understood that the present invention is not limited to the embodiments described above, but encompasses any and all embodiments within the scope of the following claims.

I claim:

1. Adjustable configuration seating, comprising:

first and second rigid lateral frame members, each of the frame members having a peripheiy;

a rigid first seating panel extending between each of the lateral frame members, the first seating panel having a forward edge extending between the periphery of each of the lateral frame members, a rearward edge opposite the forward edge, a first panel seating surface, and a first panel undersurface opposite the first panel seating surface;

a rigid second seating panel extending between each of the lateral frame members, the second seating panel having a forward edge extending between the peripheries of the lateral frame members, a rearward edge opposite the forward edge, a second panel seating surface, and a second panel undersurface opposite the second panel seating surface, the rearward edge being affixed to the rearward edge of the first seating panel, defining a seating panel joint;

a back panel crossmember extending between each of the lateral frame members;

a rigid back panel having a lateral slot disposed therethrough, the back panel crossmember passing through the slot of the back panel, the back panel being adjustably captured upon the crossmember and between each of the lateral frame members, the back panel further having an upper edge, a lower edge opposite the upper edge, a first backrest surface, and a second backrest surface opposite the first backrest surface; and a rigid intermediate seating panel having a first seating surface, a second seating surface opposite the first seating surface, a forward edge, and a rearward edge opposite the forward edge, the forward edge of the intermediate panel being pivotally attached to the seating panel joint of the first seating panel and the second seating panel, the rearward edge of the intermediate panel being pivotally attached to the lower edge of the back panel.

2. The adjustable configuration seating according to claim 1, further including at least one cushion selectively attached to a corresponding one of the panels.

3. The adjustable configuration seating according to claim 2, wherein the at least one cushion comprises a plurality of mutually selectively attached cushions.

4. The adjustable configuration seating according to claim 1, further including a selectively attached armrest accessory.

5. The adjustable configuration seating according to claim 1,wherein each of the lateral frame members has a rectangular configuration having first through fourth frame elements, the seating further comprising:

a plurality of protrusions extending from at least one of the frame elements of each of the lateral frame members; and a corresponding plurality of protrusion engaging receptacles formed in a corresponding at least one of the frame elements of each of the lateral frame members.

6. The adjustable configuration seating according to claim 1, further including a headrest removably secured to the upper edge of the back panel.

* * * * *